US006292956B1

(12) United States Patent
Kayahara

(10) Patent No.: US 6,292,956 B1
(45) Date of Patent: Sep. 25, 2001

(54) WATER FLUSH TOILET BOWL AND A CAST MOLDING APPARATUS THEREOF

(75) Inventor: Toshiaki Kayahara, Fukuoka (JP)

(73) Assignee: Toto, Ltd., Fukuoka (JP)

( * ) Notice: Subject to any disclaimer, the term of this patent is extended or adjusted under 35 U.S.C. 154(b) by 0 days.

(21) Appl. No.: 09/341,547

(22) PCT Filed: Jan. 12, 1998

(86) PCT No.: PCT/JP98/00070

§ 371 Date: Jul. 13, 1999

§ 102(e) Date: Jul. 13, 1999

(87) PCT Pub. No.: WO98/30761

PCT Pub. Date: Jul. 16, 1998

Related U.S. Application Data

(63) Continuation-in-part of application No. 08/718,513, filed as application No. PCT/JP95/00676 on Apr. 6, 1995, now Pat. No. 5,819,326.

(30) Foreign Application Priority Data

Apr. 8, 1994 (JP) ..... 6-70788
Jan. 13, 1997 (JP) ..... 9-003812
Oct. 24, 1997 (JP) ..... 9-292055

(51) Int. Cl.[7] ..... E03D 11/00
(52) U.S. Cl. ..... 4/420; 4/421; 4/428
(58) Field of Search ..... 4/420, 421, 424, 4/425, 428, DIG. 7, 252.1–252.3; 285/24, 27

(56) References Cited

U.S. PATENT DOCUMENTS 4,171,548 * 10/1979 Wilson ..... 4/421
4,672,689 6/1987 Heinze et al. ..... 4/485
5,176,406 * 1/1993 Straghan ..... 285/24
5,487,193 * 1/1996 Hennessy ..... 4/328
5,918,325 * 1/1999 Arita et al. ..... 4/420

FOREIGN PATENT DOCUMENTS 5044650 12/1975 (JP) .
61130674 8/1986 (JP) .
235134 2/1990 (JP) .
4161538 6/1992 (JP) .
439328 6/1992 (JP) .
563802 8/1993 (JP) .
679877 11/1994 (JP) .
95/27833 * 10/1995 (WO) ..... 4/252.1

* cited by examiner

*Primary Examiner*—Gregory L. Huson
*Assistant Examiner*—Tuan Nguyen
(74) *Attorney, Agent, or Firm*—Carrier, Blackman & Associates, P.C.; Joseph P. Carrier; William D. Blackman

(57) ABSTRACT

For forming a main body of a toilet bowl with which installation operation of a trap device is easy and which is superior in ornamental design possibilities and that has sufficient mechanical strength, the main body (1) of the toilet bowl is formed by cast molding as a unit with a bowl portion (3), a rising pipe (5) which is continuous with a drain opening (4) of the bowl portion, a falling pipe (6) which is continuous with the rising pipe (5) and a skirt portion (7) covering from a side portion to a rear portion thereof, and is opened in the lower portion and the rear portion of the main body, and further a fold back portion (8) is formed as a unit from the main body of the toilet bowl in the rear portion thereof.

20 Claims, 24 Drawing Sheets

WATER FLUSH TOILET BOWL AND A CAST MOLDING APPARATUS THEREOF

This application is the National Stage of International Application No. PCT/JP98/00070, filed Jan. 12, 1998, which is a continuation-in-part of U.S. application Ser. No. 08/718,513, which was the National Stage of International Application No. PCT/JP95/00676 filed Apr. 6, 1995, now U.S. Pat. No. 5,819,326.

BACKGROUND OF THE INVENTION

1. Field of the Invention

The present invention relates to a water flush toilet bowl in which a bowl main body and a trap device are separately constructed, and a cast molding apparatus for such a toilet bowl.

2. Description of the Related Art

If a water flush toilet bowl is formed by slip casting as a unit including a trap portion thereof the trap portion is exposed at a side face of the toilet bowl. This is not only undesirable from a view point of ornamental design but also has a drawback that it is easily stained and difficult to wash out.

A water flush toilet bowl provided with a skirt portion around the main body of the bowl, in which the trap device is accepted, has already been disclosed, for example in U.S. Pat. No. 4,672,689 or International Publication WO 95/27833. When the skirt portion is provided around the main body of the bowl, since it is difficult to form the main body of the bowl and the trap together as a unit due to restrictions in the construction of the casting mold, the main body of the bowl and the trap must be separately formed, and then the trap is attached to the bowl main body afterwards.

With the toilet bowl shown in International Publication WO 95/27833, only a lower face is opened, and therefore it is difficult work to attach the trap afterwards. On the other hand, with the toilet bowl shown In U.S. Pat. No. 4,672,689, as seen in FIG. 35, it is easy work to attach the trap device 101 afterwards since the lower face and the rear face of the toilet bowl 100 are continuously opened.

However, in the toilet bowl shown in U.S. Pat. No. 4,672,689, it is impossible to adjust the length of the trap device easily with respect to fitting the position of a drain pipe, and therefore cutting the drain pipe is necessary for adjusting the length thereof, which is troublesome.

Further, when the lower face and the rear face of the toilet bowl are continuously opened, the rear edge portion 103 of the skirt portion 102 is short or insufficient in mechanical strength, and therefore cracks and breaks are easily caused at this portion during the process of attaching the trap device. For resolving this problem, the thickness of the skirt portion 102 must be increased, however it takes a long time build up sufficient thickness in the casting process and also production costs are greater.

SUMMARY OF THE INVENTION

For resolving the above mentioned problems, it is an object of the present invention to provide a water flush toilet bowl formed as a unit integrally with a bowl portion of a main body, a portion of a trap device, and a trap cover portion covering said trap portion.

Said trap cover portion is formed on a lap surface except for a lower portion and a rear portion thereof.

In this case, a reinforcement portion can be formed to reinforce the opening portion on a part of the opening portion at the rear portion of the main body so as to enhance the mechanical strength thereof.

Said reinforcement portion can better be formed as a unit integrally with said trap cover portion, rather than being formed separately then united on said opening portion.

As for the form of said reinforcement, it can be formed as a folded-back portion formed with the unit integrally.

Said trap cover portion can be formed on a lap surface except for a lower portion.

Here, said trap device can be formed by a connection pipe connecting between the upper stream connection pipe and the lower stream connection pipe, thereby forming a water staying portion forming a trap seal bridging over the upper stream connection pipe, the lower stream connection pipe and the connection pipe. Alternatively, a water staying portion to achieve the trap seal can be formed in the upper stream connection pipe.

Further, the main body of the toilet bowl can be fixed onto a floor through the upper stream connection pipe or the lower stream connection pipe, and in that case it is preferable to provide a mechanism for finely adjusting a position of the main body of the toilet bowl, at either one of the main body of the toilet bowl, or the upper stream connection pipe and the lower stream connection pipe.

Additionally, at least a portion of said trap device can be formed as a unit together with an adjusting element for adjusting the height of the main body of the toilet bowl, thus making the use thereof easy for handicapped persons.

Moreover, it is also possible to provide a choking portion for adjusting the opening area at the opening portion of the drain side of the lower stream connection pipe of the trap device.

Also, in the case of said trap device being formed together with the upper stream connection pipe, the lower stream connection pipe and the connection pipe, these pipes can be formed with a corresponding means to align their connection. The means may be marks formed on each pipe or may be convex and concave parts engaging each other.

Further, when said trap device is formed with the upper stream connection pipe, the lower stream connection pipe and the connection pipe, the external diameter of the connection pipe can be nearly equal to the internal diameter of the upper stream connection pipe and the lower stream connection pipe, such that the connection pipe fitted into the upper stream connection pipe and the lower stream connection pipe can slide with no escape of liquid. In this case, it is better that these pipes be formed to fit into each other like a key and keyhole.

Also, in accordance with the present invention, a cast molding apparatus for a flush toilet bowl is provided comprising:

a body mold for casting a bowl portion of the toilet bowl, a rising pipe formed to be continuous with a drain opening of said bowl portion, a falling pipe formed to be continuous with said rising pipe, a cover portion covering a portion bridging from a side face to a front face, and a fold back portion formed around an opened rear portion of the toilet bowl; and a rim mold for forming rim portions; wherein said body mold is constructed with a top mold, a bottom mold and right and left side molds, said top mold has surfaces for forming said bowl portion and upper portions of said rising pipe and said falling pipe, said bottom mold has surfaces for forming lower portions of said rising pipe and said falling pipe, an inner surface of said cover portion and an inner surface of said fold back portion, and said right and left side molds have surfaces for forming an outer surface of said cover portion and an outer surface of said fold back portion.

Further, in accordance with the present invention, a cast molding apparatus for a water flush toilet bowl is provided comprising:

a body mold for casting a bowl portion of the toilet bowl, a rising pipe formed to be continuous with a drain opening of said bowl portion, a falling pipe formed to be continuous with said rising pipe, a cover portion covering a portion bridging from a side face to a front face, and a rear portion of the toilet bowl; and a rim mold for forming rim portions; wherein said body mold is constructed with a top mold, a bottom mold and right and left side molds, said top mold has surfaces for forming said bowl portion and upper portions of said rising pipe and said falling pipe, said bottom mold has surfaces for forming lower portions of said rising pipe and said falling pipe, an inner surface of said cover portion and an inner surface of said rear portion, and said right and left side molds have surfaces for forming an outer surface of said cover portion and an outer surface of said rear portion.

DETAILED DESCRIPTION OF THE PREFERRED EMBODIMENTS

Figure 1:
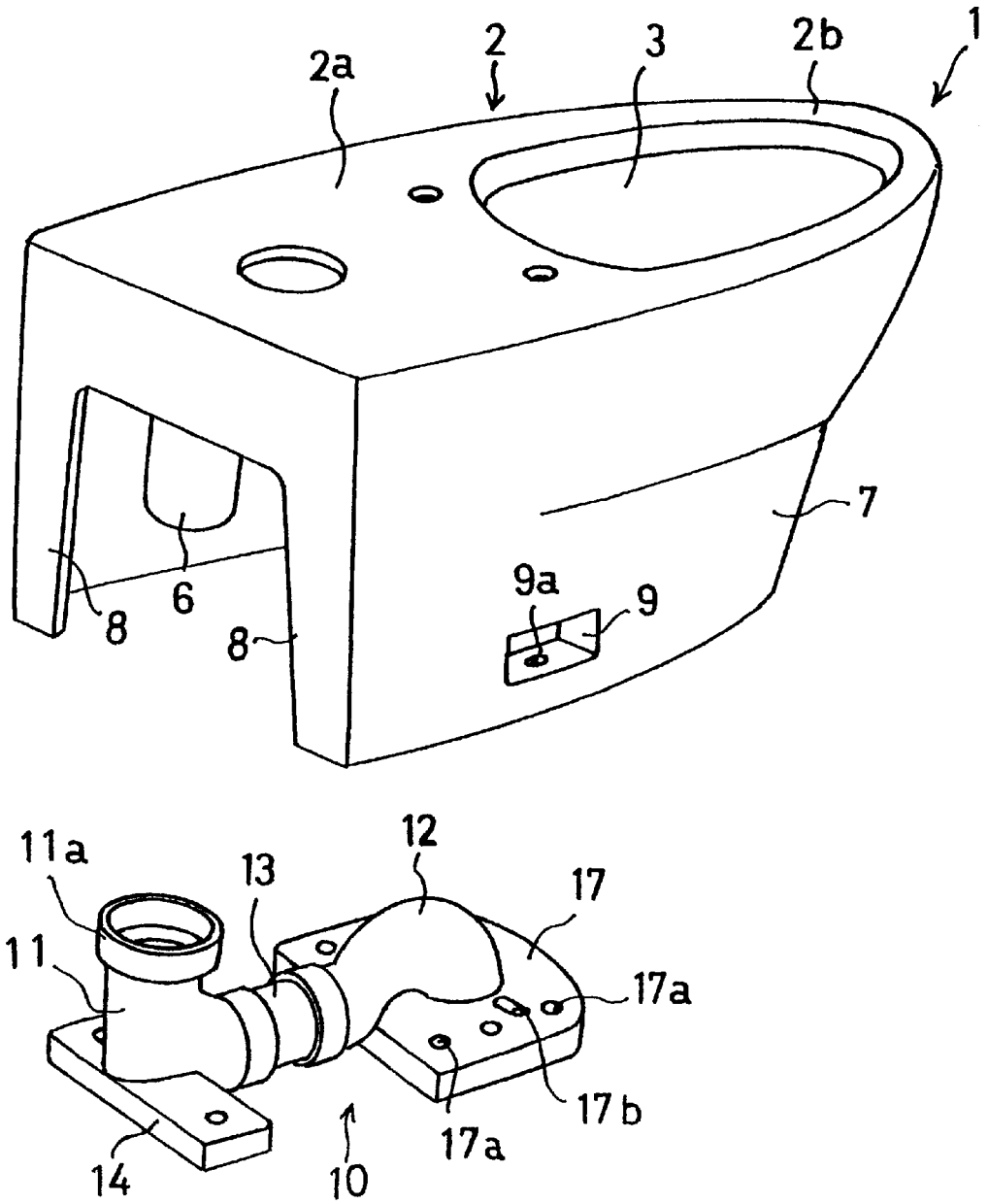
FIG. 1 is a perspective view showing a main body of a toilet bowl and a trap device of a water flush toilet bowl, in accordance with the present invention, separately.
Figure 2:
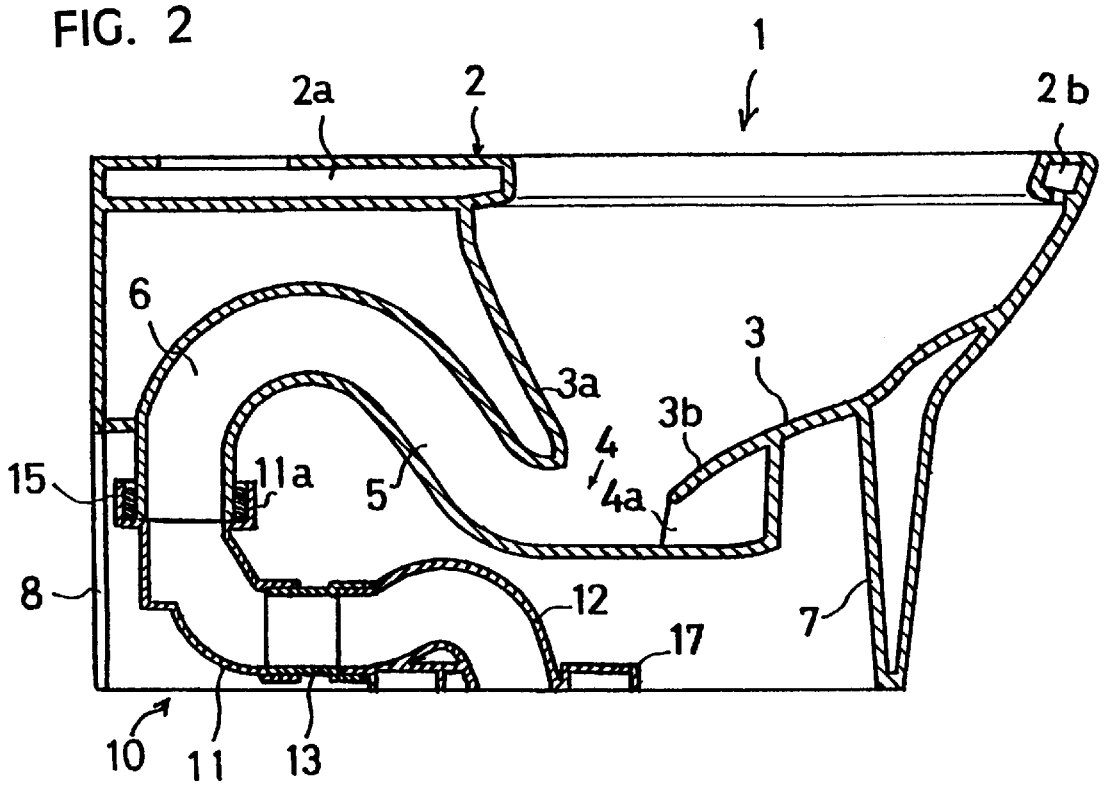
FIG. 2 shows a vertical cross-sectional view of the main body of the toilet bowl.

Hereinafter, detailed explanation of the preferred embodiments according to the present invention and comparisons will be given by referring to the attached drawings. FIG. 1 is a perspective view showing a main body of a toilet bowl and a trap device of a water flush toilet bowl, in accordance with the present invention, separately. FIG. 2 is a vertical cross-section view of the main body of a toilet bowl, and FIG. 3 a vertical cross-section view of the trap device, wherein the main body 1 of the toilet bowl is provided at an upper portion thereof with a rim portion 2 which is connected thereto after being formed separately, and the rim portion 2 forms a water supply chamber 2*a* in the rear portion thereof, on which chamber is positioned a low tank, etc. And, from the water supply chamber 2*a*, flush water is supplied to a rim water path 2*b* which is positioned on an upper edge of the bowl portion.

The main body 1 of the toilet bowl is formed as a unit together with a bowl portion 3, a rising pipe 5 which is continuous with a drain opening 4 of the bowl portion, a falling pipe 6 which is continuous with the rising pipe 5, and a skirt portion 7 (shaped skirt) as the cover portion which covers a portion from a side face to a front face, by a slip casting, and is also opened in a lower portion and a rear portion thereof. Further, a fold back portion 8 is formed from the main body of the toilet bowl as a unit in the rear portion thereof, and two cut portions 9 for fixing the toilet bowl through a trap device 10 are formed in a lower portion of the skirt portion 7. Note that only one cut portion 9 can be seen in FIG. 1, however the second cut portion is formed symmetrically with the first on the opposite side of the skirt portion 7.

Here, in the main body 1 of the toilet bowl, a bowl rear plate 3*a* and an upper plate 3*b* of a jet eject opening 4*a* are attached after the main body 1 of the toilet bowl is formed separately.

The trap device 10 is constructed with an upper stream connection pipe 11 which is connected to a drain opening at the lower edge end of the falling pipe 6, a lower stream connection pipe 12 which is connected to a drain opening formed on a floor, and a connection pipe 13 which interconnects between the upper and lower stream connection pipes 11 and 12.

Figure 5:
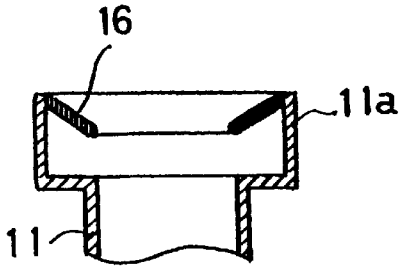
FIG. 5 shows a cross-sectional view of another embodiment of an upper stream connection pipe forming the trap device.

The upper stream connection pipe 11 is fixed to the floor with a plate 14 (as best seen in FIG. 1), and at the upper edge portion thereof is provided an enlarged diameter portion 11*a* in which a seal ring 15 is inserted between an interior side of the enlarged diameter portion 11*a* and an outer side of the falling pipe 6. However, in place of inserting the seal ring 15 as a separate body, it is also possible to provide a seal portion 16 on the interior surface of the enlarged diameter portion 11*a* as a unit, as shown in FIG. 5.

Figure 6:
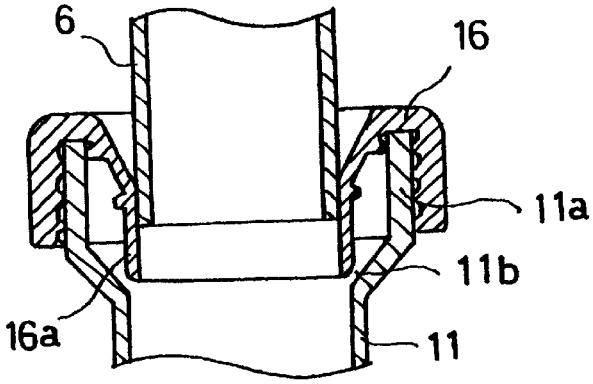
FIG. 6 shows a cross-sectional view of another embodiment of the seal portion of the upper stream connection pipe.

A seal portion 16, as shown in FIG. 6, can cap the outer side of the enlarged diameter portion 11*a*. The inside of the seal portion 16 is formed with a skirt portion 16*a* with sealingly engages the lower edge portion of the falling pipe 6. This skirt portion 16*a* is placed lower than the lower edge portion of the falling pipe 6 therefore keeping small an opening between the lower edge of the skirt portion 16*a* and the enlarged diameter portion 11*a*.

By virtue of this kind of arrangement, flush water can not flow into the opening between the enlarged diameter portion 11*a* and the skirt portion 16*a*, and it is possible to create a siphon effect efficiently.

The lower stream connection pipe 12 is fixed with a plate 17. On this plate 17 are formed plural holes 17*a* for fixing the main body 1 of the toilet bowl onto the floor through attachment holes 9*a* of the cut portions 9 mentioned above, and plural holes 17*b* for fixing a flange 20 (see FIG. 13), joint bolts 19 of which are inserted into the drain opening formed on the floor, and the plate 17 is so constructed that the mounting or attaching position thereof can be finely adjusted by providing the plural holes 17*a* and suitably adjusting the position of the joint bolts 19.

Figure 3:
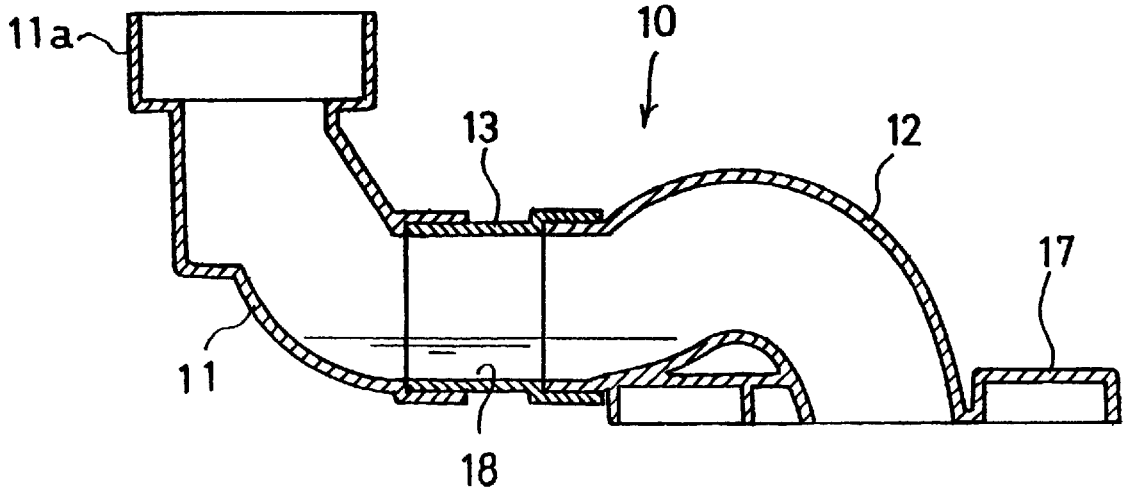
FIG. 3 shows a vertical cross-sectional view of the trap device.

And, as shown in FIG. 3, the connection pipe 13 is inserted into the above mentioned upper stream connection pipe 11 and onto the lower stream connection pipe 12, and a water stay portion 18 defining a trap seal is formed, bridging over the upper stream connection pipe 11, the lower stream connection pipe 12 and the connection pipe 13.

In this way, by forming the water stay portion 18 extending to the lower stream connection pipe 12, it is possible to create a siphon effect without resistance in the water flow, thereby being effective for conserving water.

Figure 4:
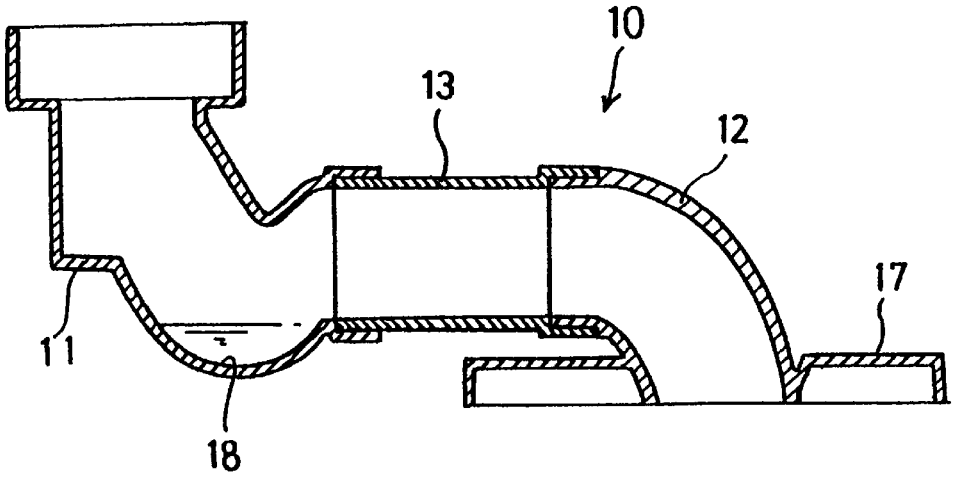
FIG. 4 shows a cross-sectional view similar to FIG. 3 of another embodiment of the trap device.

However, it is possible to form the water stay portion 18 only at the upper stream connection pipe 11 as shown in FIG. 4. With such a construction, it is somewhat more disadvantageous than that shown in FIG. 3 with respect to the water conservation, however, it is possible to protect the connection portions from leakage with certainty.

Figure 7:
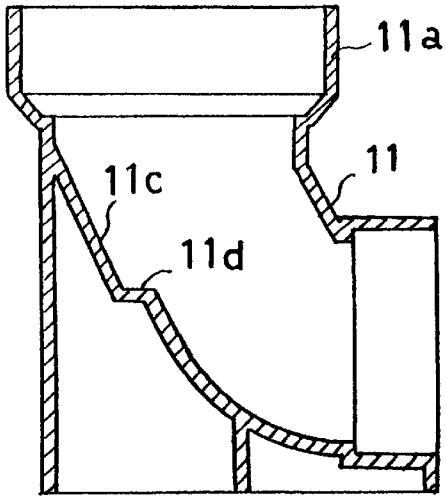
FIG. 7 is a cross-sectional view of another embodiment of the upper stream connection pipe.
Figure 8:
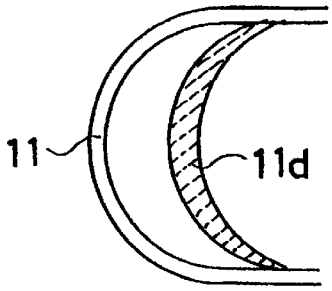
FIG. 8 shows a plan view of the upper connection pipe as shown in FIG. 7.
Figure 9:
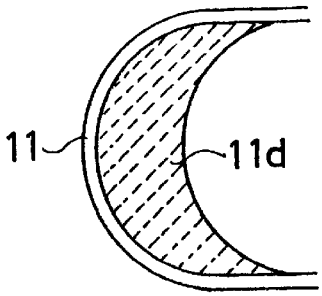
FIG. 9 shows a plan view of the upper connection pipe of the trap device as shown in FIG. 3.

FIG. 7 shows a cross-sectional view of another embodiment of the upper stream connection pipe, FIG. 8 shows a plan view of the upper stream connection pipe and, FIG. 9 shows a plan view of the upper stream connection pipe of the trap as shown in FIG. 3. The horizontal step area 11*d* as shown in the embodiment of FIG. 7 and 8, is formed smaller than in the first embodiment as shown in FIG. 9, on account of the wall portion 11*c* of the upper stream connection pipe 11 being inclined.

In the case of the amount of flush water flowing into the upper stream connection pipe being small at the beginning, as shown in FIG. 9, much time and water is used, which is not effective for draining and conserving water while serving the purpose of creating a siphon effect.

Therefore, as shown in FIG. 7 and 8, the area of a horizontal step 11*d* is smaller than the area of the embodiment shown in FIG. 9, so that it is possible to efficiently and effectively provide water for draining and also to create a siphon effect in the case of a toilet bowl which provides little flush water flowing into the upper stream connection pipe 11 at the beginning of the flush.

Figure 10A:
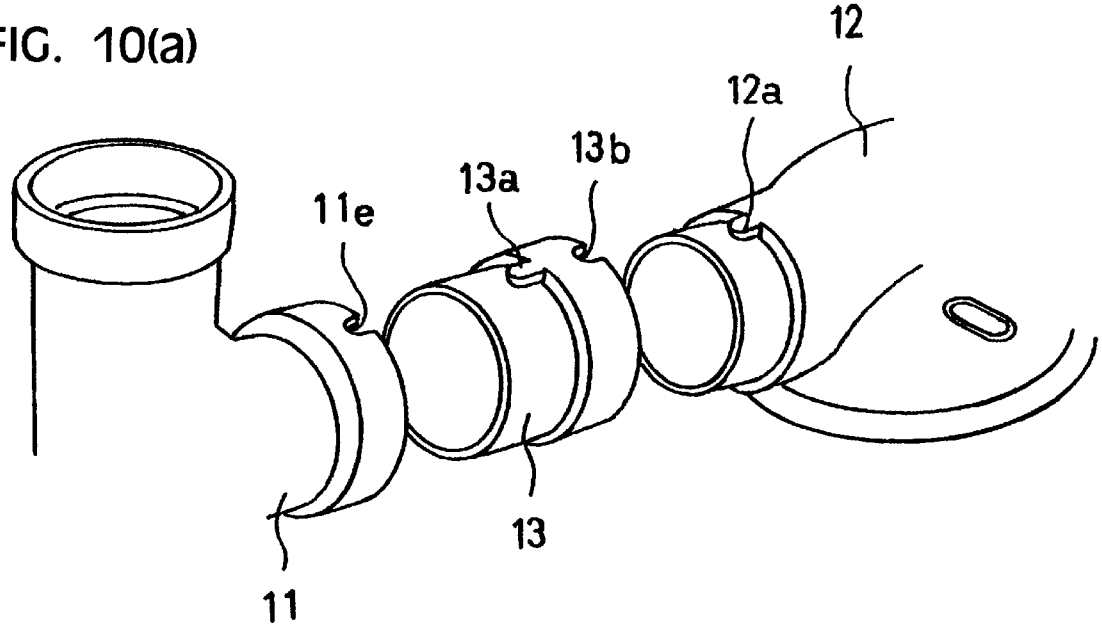
FIG. 10 (*a*) and (*b*) are perspective views of other embodiments of the trap device.
Figure 10B:
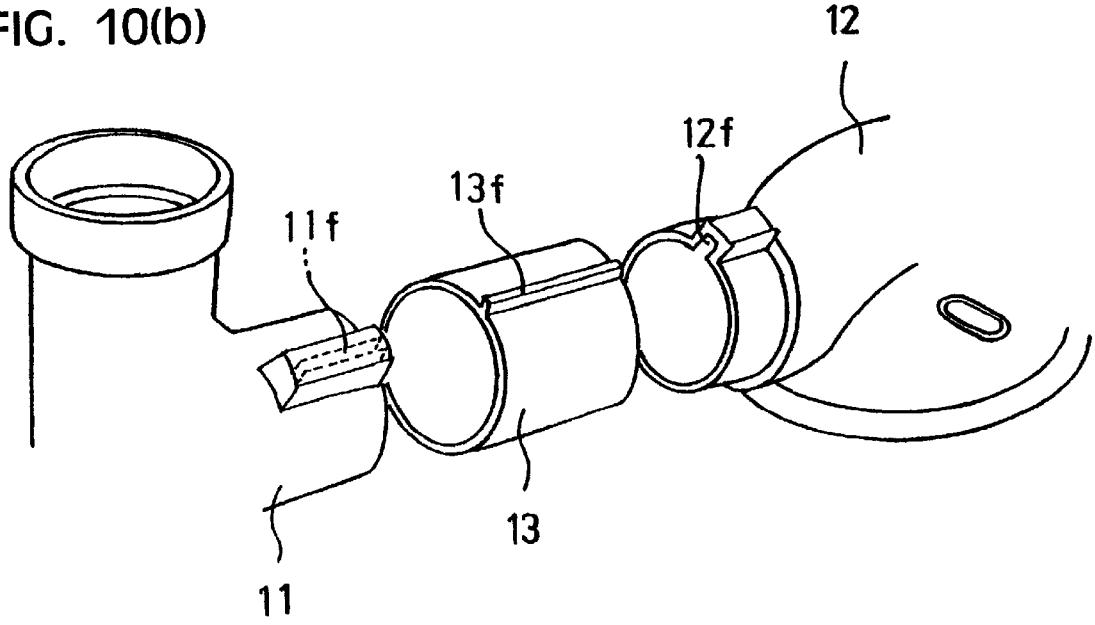

FIG. 10(*a*) is a perspective view showing another embodiment of the trap device. In this embodiment a concave portion 11*e* and a convex portion 13*a* are formed fitting into the upper stream connection pipe 11 and the connection pipe 13, and a concave portion 13*b* and a convex portion 12*a* are formed fitting into the connection pipe 13 and the lower stream connection pipe 12.

In this way, with torsion the fit can be secured with certainty if the upper stream connection pipe 11, the connection pipe 13 and the lower connection pipe are round pipes.

FIG. 10(*b*) is a perspective view showing another embodiment of the trap device. In this embodiment, the external diameter of the upper connection pipe 13 is formed approximately equal to the internal diameter of the lower connection pipe 11, and the upper stream connection pipe 11 and the lower connection pipe 12 are formed with key holds 11*f* and 12*f*, while the connection pipe 13 is formed with a key 13*f* for fitting into the key holds 11*f* and 12*f*.

In this way, the connection pipe 13 is fit into the upper stream connection pipe and the lower connection pipe in order that liquid can not escape and so that the pipes are able to slide relative to each other. Accordingly, as the connection pipe 13 can be cut to length at will, it is more freely set up.

Figure 11:
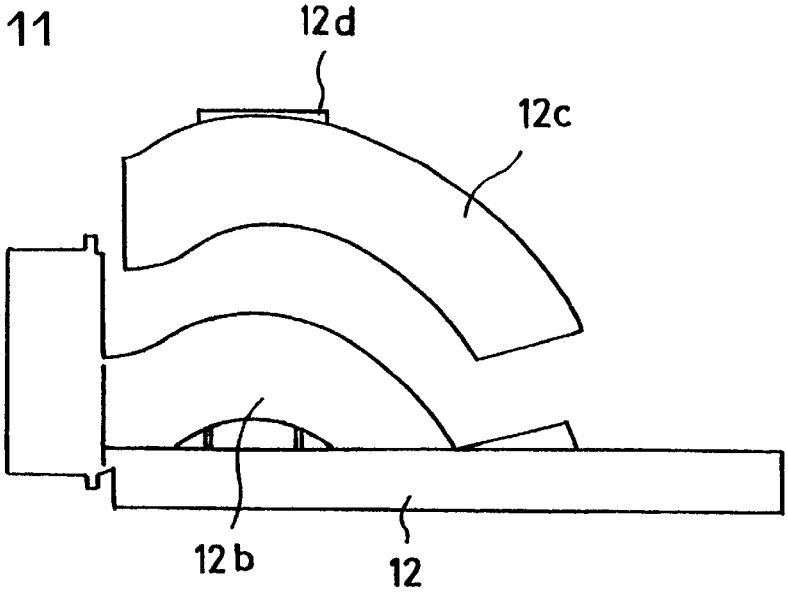
FIG. 11 is a drawing of another embodiment of the lower connection pipe forming the trap device.
Figure 12:
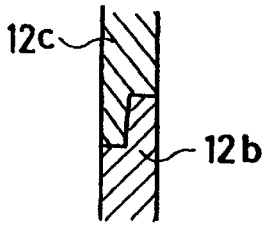
FIG. 12 shows a cross-sectional view of the connecting portion when the lower connecting pipe is divided into two pieces.

FIG. 11 shows another embodiment of the lower connection pipe of the trap device, and FIG. 12 is a cross-sectional view of a fitting portion used in the case that the lower connection pipe is divided into two pieces. In this embodiment the lower connection pipe 12 is divided between the main body of the pipe 12*b* and the upper bowl portion 12*c*. In the case of the lower connection pipe being curved, as the lower connection pipe can not be formed with injection by one form, it can be divided into some pieces.

Although there is a problem of reduced strength and escape of water in the connecting portion when it is divided into some pieces, this can be solved by forming a step at the connecting portion as shown in FIG. 12.

When fitting, the upper bowl portion 12*c* should be pressed to the main pipe 12*b* with a clamp, and if the upper bowl portion 12*c* is formed with a rib 12*d*, the operation becomes facile.

Additionally, the above mentioned connection pipe 13 can be increased or decreased in the number thereof. Namely, a distance between the wall at the rear side of the toilet bowl to the center of the drain opening on the floor is called the "rough-in", and the total length of the trap device 10 can be adjusted corresponding to the length of the "rough-in", by increasing or decreasing the number of connection pipes 13 used.

Figure 13:
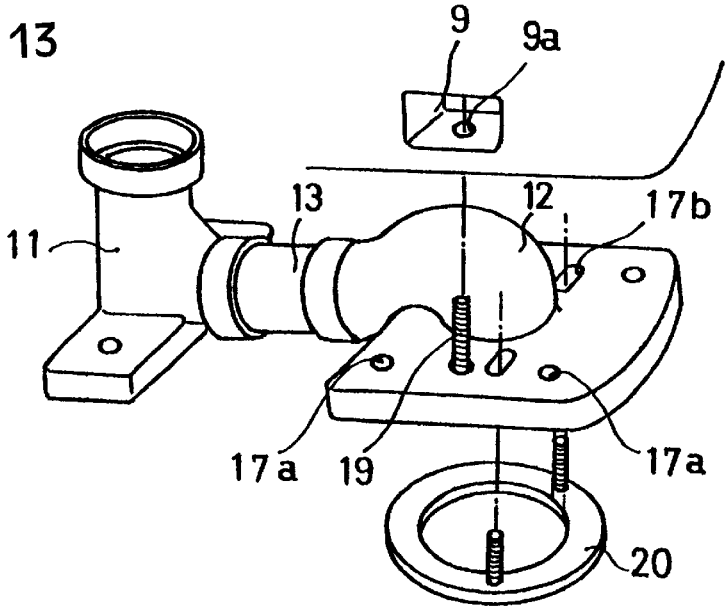
FIG. 13 is a drawing for explaining a method for forming a connection between the lower stream connection pipe forming the trap device and the main body of the toilet bowl.
Figure 14A:
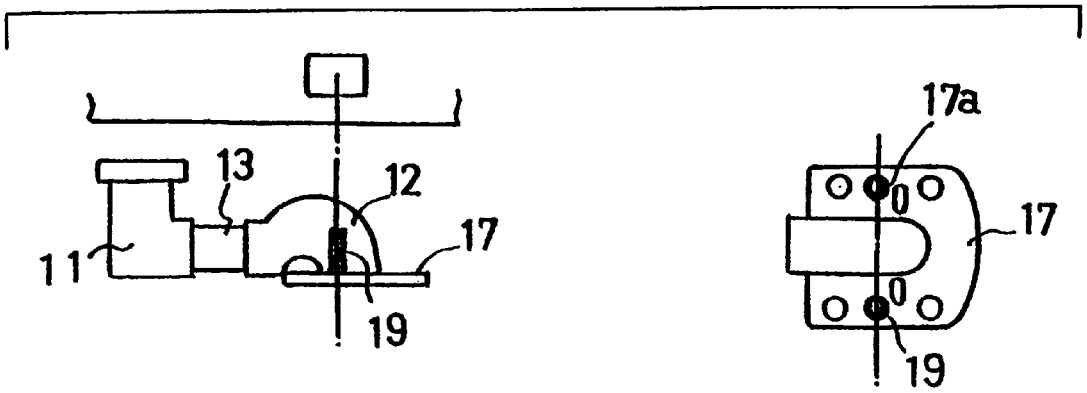
FIG. 14 (*a*) to (*c*) are drawings for explaining adjustment of length of the trap device.
Figure 14B:
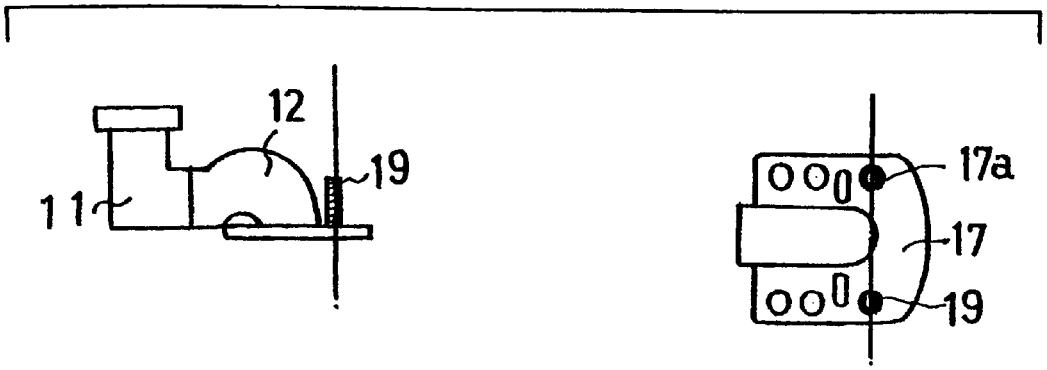
Figure 14C:
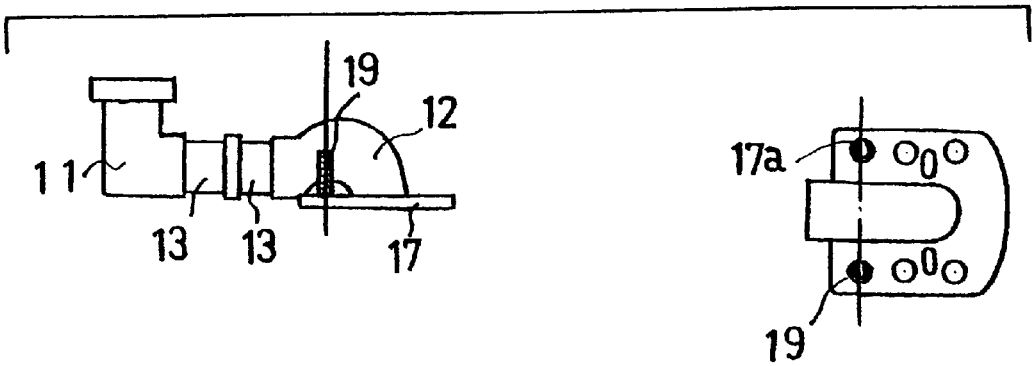

Namely, FIG. 13 and FIG. 14(*a*) show a "rough-in" of 12 inches in length, and in this case, only one connection pipe 13 is connected between the upper stream connection pipe 11 and the lower stream connection pipe 12 and joint bolts 19 are penetrated through the holes 17*a* located at intermediate positions on the plate 17.

And in the case that the length of the "rough-in" is 10 inches, as shown in FIG. 14(*b*), the connection pipe 13 can be omitted, and the joint bolts 19 are inserted through the holes 17*a* located at the outermost periphery of the plate 17. And, in the case that the length of the "rough-in" is 14 inches, as shown in FIG. 14(*c*), two connection pipes 13 are connected and the joint bolts 19 are penetrated through the holes 17*a* located at the innermost periphery of the plate 17.

In this way, by using such an adjustable construction of the connection pipe(s) 13 corresponding to the "rough-in" without having to cut it, it is possible to complete the installing operation quickly without errors.

Figure 15:
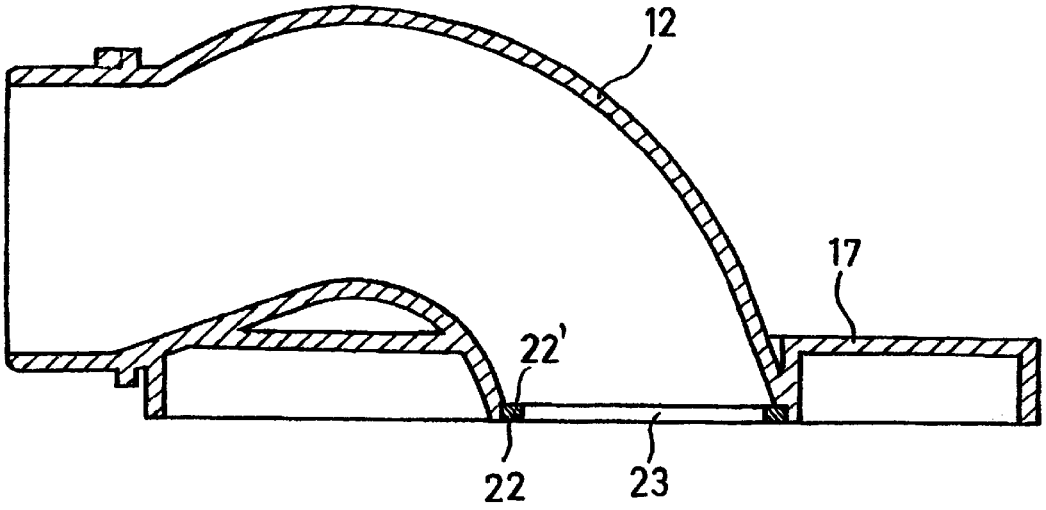
FIG. 15 shows a cross-sectional view of another embodiment of the lower stream connection pipe forming the trap device.

In FIG. 15 showing a cross-section view of another embodiment of the lower stream connection pipe forming the trap device, an adjusting ring or choking portion 22 is detachably inserted into an opening portion 23 at the side of the drain opening of the floor of the lower stream connection pipe 12, thereby allowing the opening area to be adjusted. However, it should be noted that the adjusting ring 22 can be formed as a unit together with the lower stream connection pipe 12.

In this way, by adjusting the opening area of the opening portion 23, the adjusting ring 22 and a step portion 22' formed by the lower stream connection pipe, depending on the amount of flushing water and waste matter flowing from the drain opening 4 into the trap device 10, it is possible to obtain an appropriate drain capability.

Figure 16:
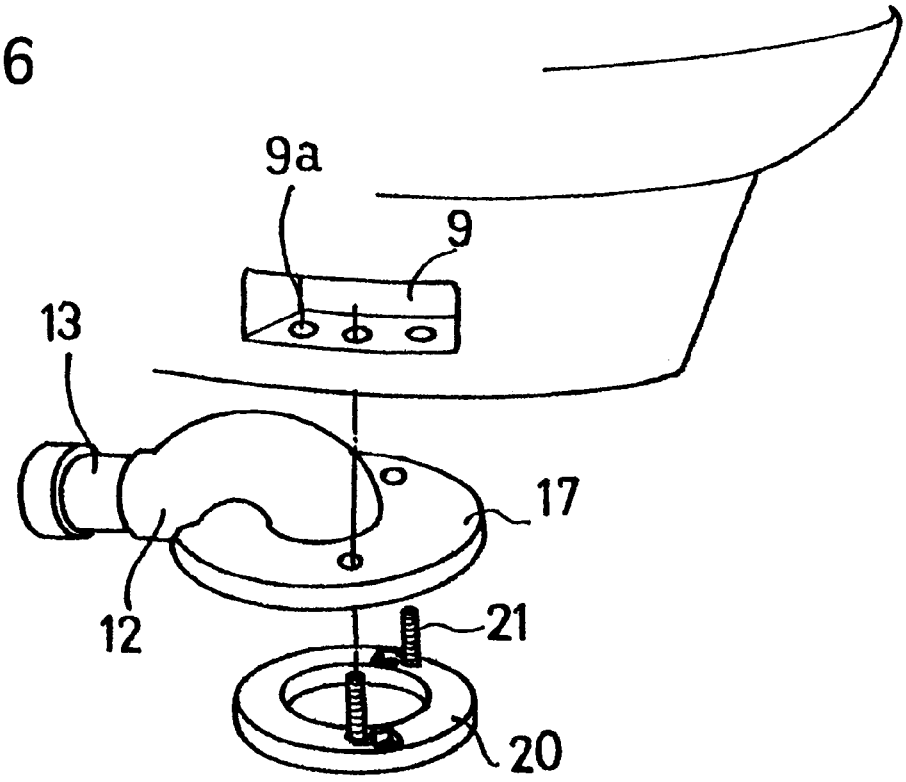
FIG. 16 is a perspective view for showing another embodiment of the connection between the lower stream connection pipe and the main body of the toilet bowl.

FIG. 16 is a perspective view showing another embodiment of the connection between the lower stream connection pipe and the main body of the toilet bowl. It is constructed so that the plate 17 is fixed onto the floor via the flange portion 20 and the main body 1 of the toilet bowl is fixed to the plate 17 as in the above mentioned embodiment. However, here, the main body 1 of the toilet bowl, the plate 17 and the flange portion 20 are, in this embodiment, together tied up through a joint bolt 21. So as not to change the installation position of the main body of the toilet bowl in spite of any change in the "rough-in", a plurality of attachment holes 9*a* are formed in the main body 1 of the toilet bowl. It should be noted that although not shown in FIG. 16, a second group of attachment holes 9*a* are formed in the opposite side of the main body 1.

Figure 17:
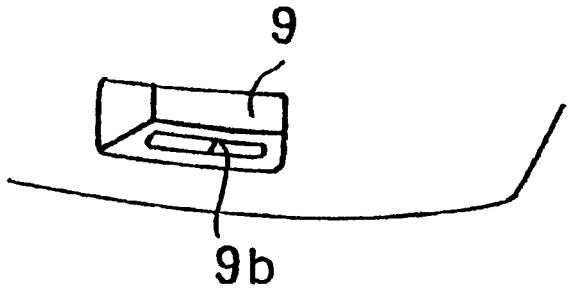
FIG. 17 is a perspective view similar to an adjustment portion of the main body of the toilet bowl in FIG. 16.

However, in place of forming the plurality of attachment holes 9*a*, a hole of elongate oval shape 9*b* can be formed instead, on each side of the toilet main body 1, as shown in FIG. 17. Also, the plate and the flange portion can be formed as a unit.

Figure 18:
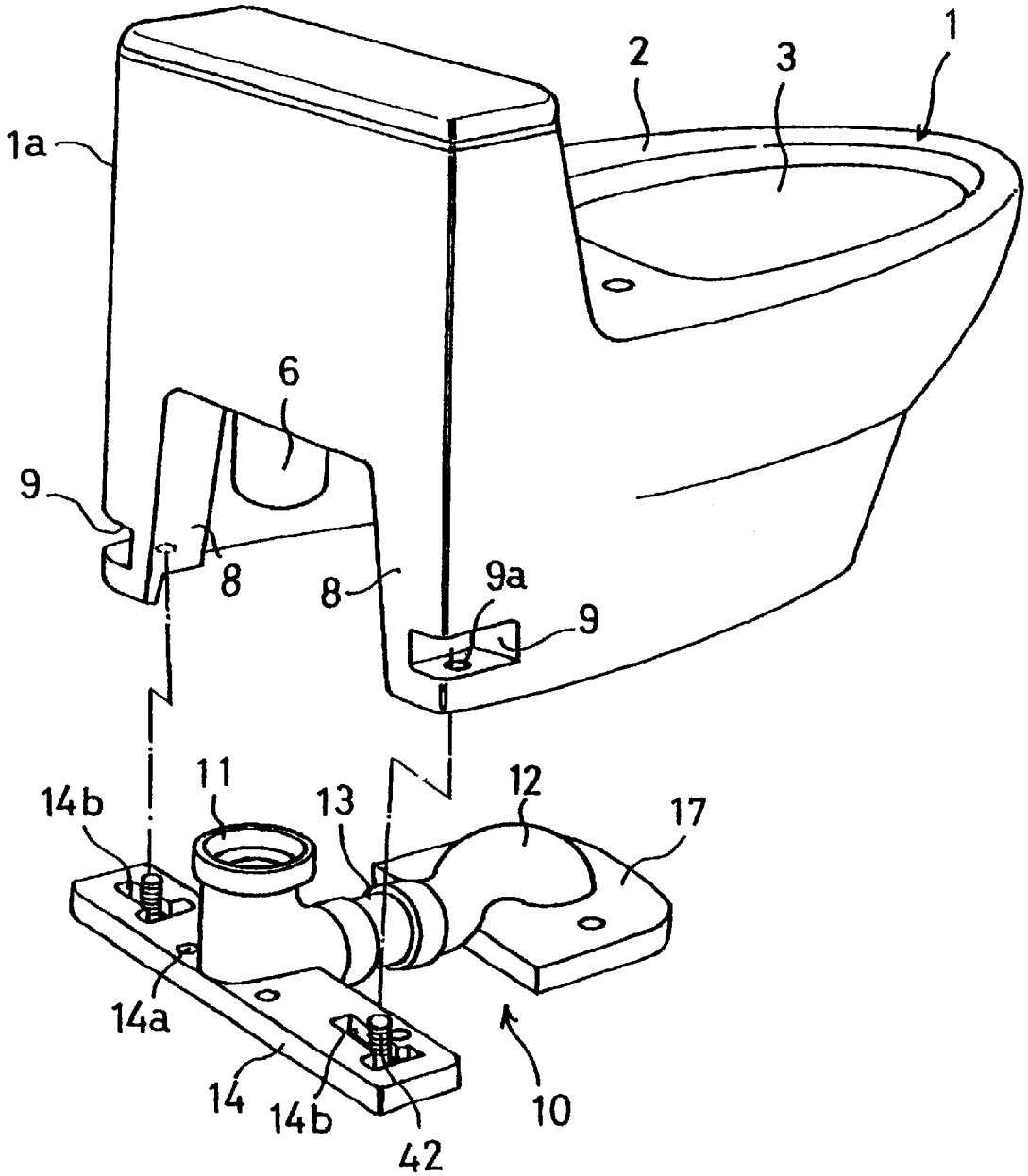
FIG. 18 a perspective view showing a main body of a toilet bowl and a trap device of a water flush toilet bowl of another embodiment, separately.

FIG. 18 is a perspective view showing the main body 1 of the toilet bowl and the trap device separately, of a water flush toilet bowl according to another embodiment. In this embodiment, a tank 1*a* is provided as a unit together with the main body 1 of the toilet bowl, and the cut portions 9 are formed in the rear lower portions of the main body 1 of the toilet bowl for connecting with the trap device 10.

Additionally, in the case where the cut portions 9 are formed in the rear lower portions of the toilet bowl which is opened at the rear portion, both sides of the rear portion can be turned up during drying step inconveniently.

Figure 19:
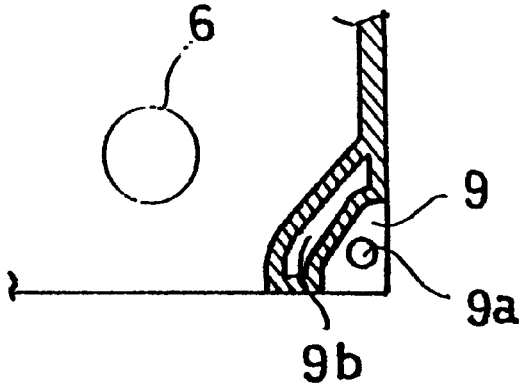
FIG. 19 shows a horizontal cross-sectional view of another embodiment of the structure of the periphery of the fixing cut portion.
Figure 20:
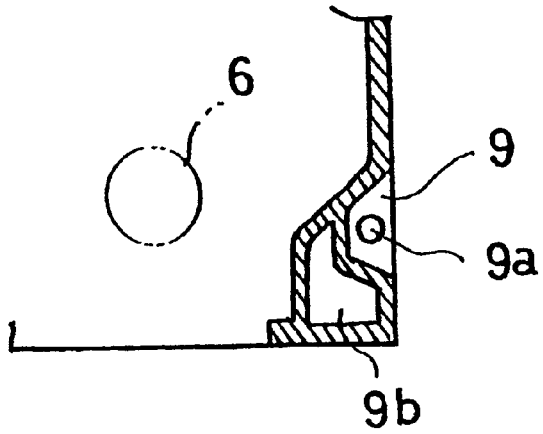
FIG. 20 shows a horizontal cross-sectional view of another embodiment of the structure of the periphery of the fixing cut portion.

As shown in FIG. 19, the inner portions of the cut portions 9 are provided with a hole portion 9*b*, and strong against bending same as the pipe. To deal with changes of shape, as shown in FIG. 20, since the cut portions 9 are not provided at edges, it would be better to position them forward a little, and to provide the hole portion 9*b* therein.

Figure 21:
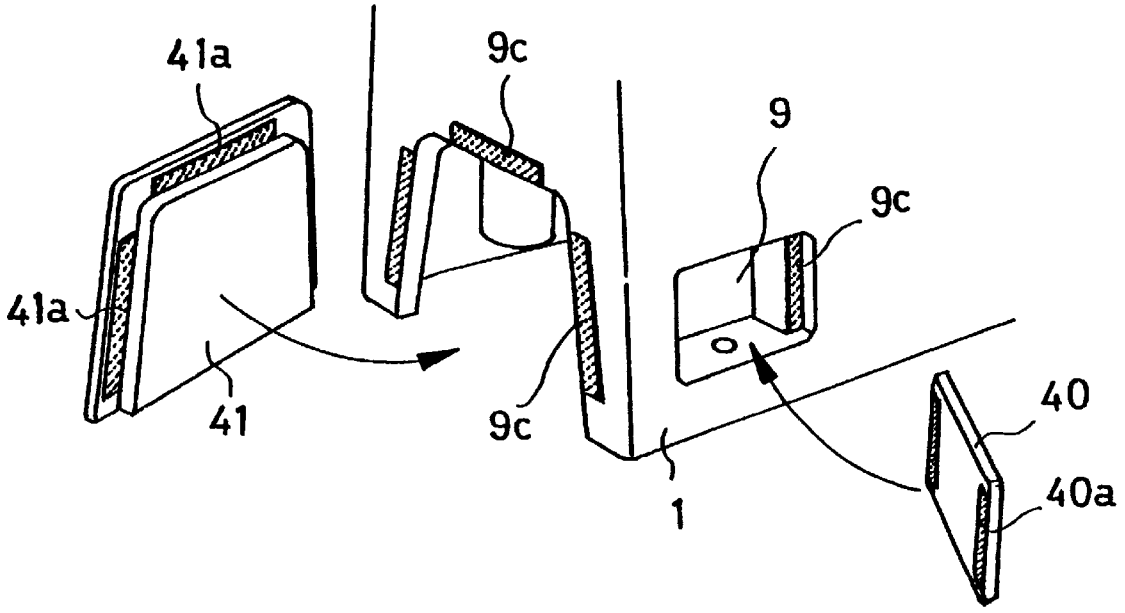
FIG. 21 is drawing of an embodiment including closing structure for the opened portions of the toilet bowl.

FIG. 21 shows an embodiment of a closure of the opened portion of the toilet bowl, the toilet bowl which being open at the cut portions 9 and the rear portion, to be fitted to prevent tampering, wherein zippers or other fastners of faces 9*c* are attached inside of the cut portion 9 and at the periphery of the rear opening portion of the toilet bowl 1. On the other hand, the zippers or other fastEners 40*a* and 41*a* are attached to the lid portion 40 which cover the cut portion 9, and to the lid portion 41 which is covering the rear opening portion of the toilet bowl 1, and the lid portions 40 and 41 are therefore free while allowing opening or closure of the cut portionS and the opened portion.

Returning to FIG. 18, the lower stream connection pipe 12 forming the trap device 10 is fixed onto the floor through the plate 17, and the upper stream connection pipe 11 is fixed onto the floor through the plural holes 14*a* provided in the plate 14 for attaching on the floor surface. Further, in the plate 14, plural holes 14*b* for attachment are formed for fixing the main body 1 of the toilet bowl through plural bolts. The holes 14*b* for attachment are shaped like a letter "T", thereby making it possible to finely adjust the installation position of the main body 1 of the toilet bowl and to adjust for proper insertion even after the upper stream connection pipe is fixed onto the floor.

Figure 22:
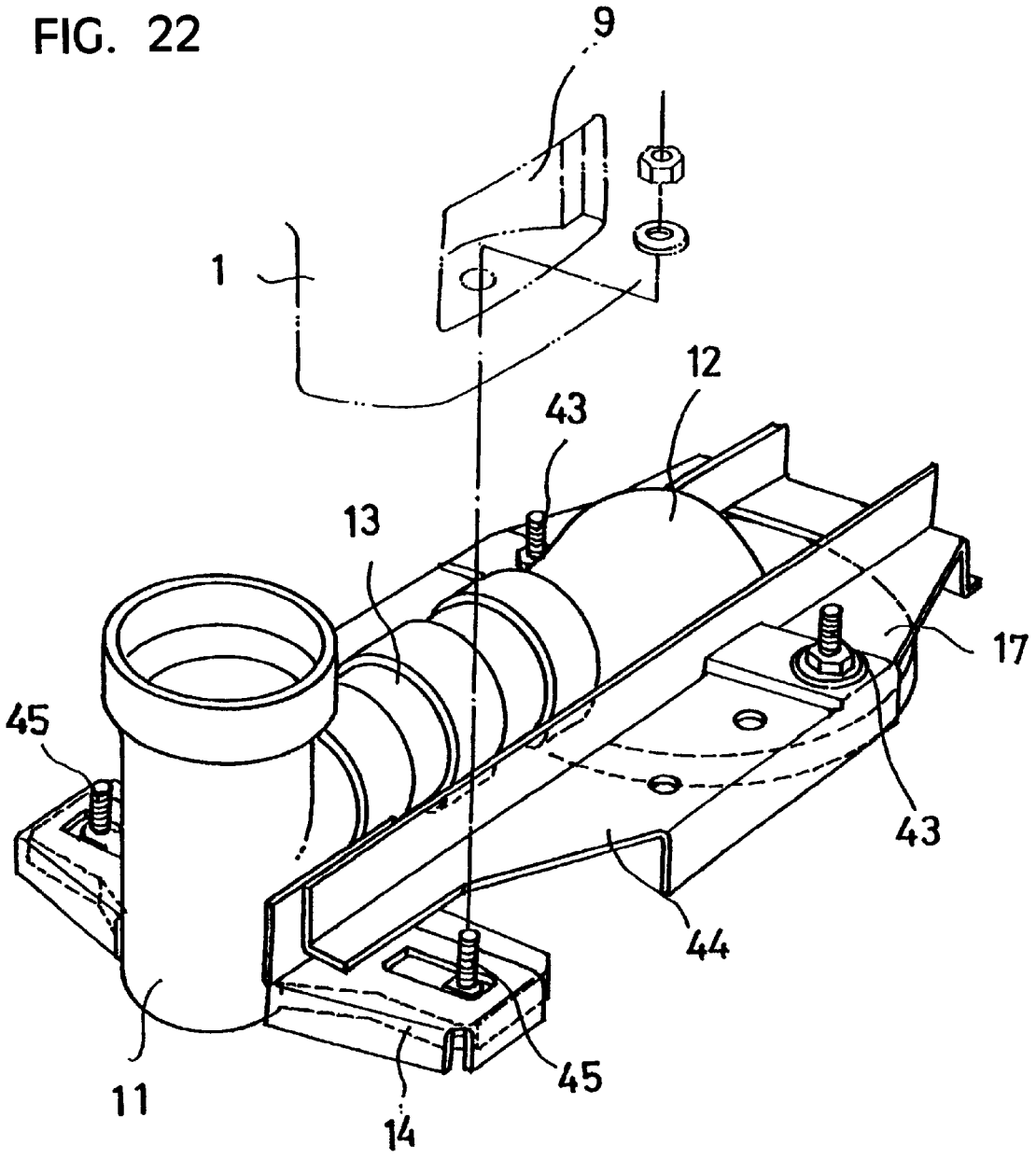
FIG. 22 shows a perspective view of the trap device of another embodiment.
Figure 23:
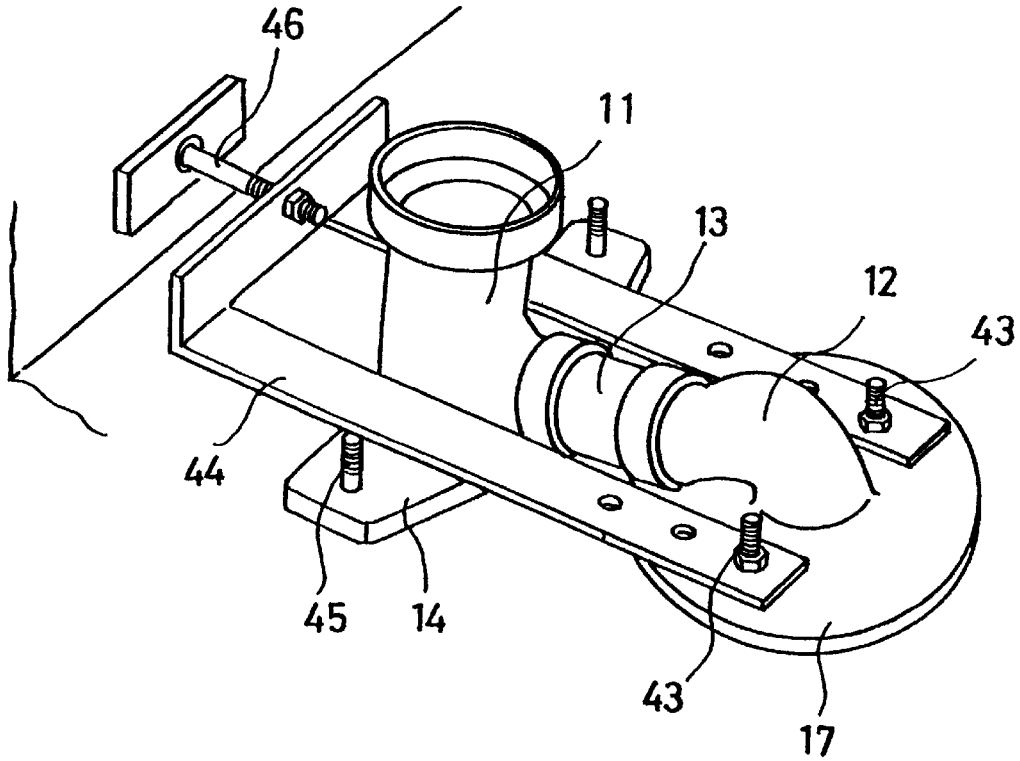
FIG. 23 shows a perspective view of the trap device of another embodiment.

FIG. 22 and 23 are perspective views which show the trap device of other embodiments. In said embodiments, bolts 45 go to the floor through a plate 14 which is attached to the upper stream connection pipe, and bolts 45 fix the toilet bowl 1 onto the floor through the plate 14. In the embodiments as shown in FIG. 22 and 23, bolts 43 connect from the floor to fix a plate 17 on the side of the lower stream connection pipe 12, the plate 17 is fixed to a frame 44, and this frame 44 is fixed to the plate 14 of the upper stream connection pipe 11, then the bolts 45 connect this plate 14 and the toilet bowl 1. Specifically, the plate 17 is fixed on the floor directly, and the plate 14 connects the trap device and the toilet bowl.

In the embodiment as shown in FIG. 23, a metal fitting 46 fixes the rear edge of the frame 44 onto the wall, and the frame 44 is secured to the plate 14 strongly from above.

Figure 24:
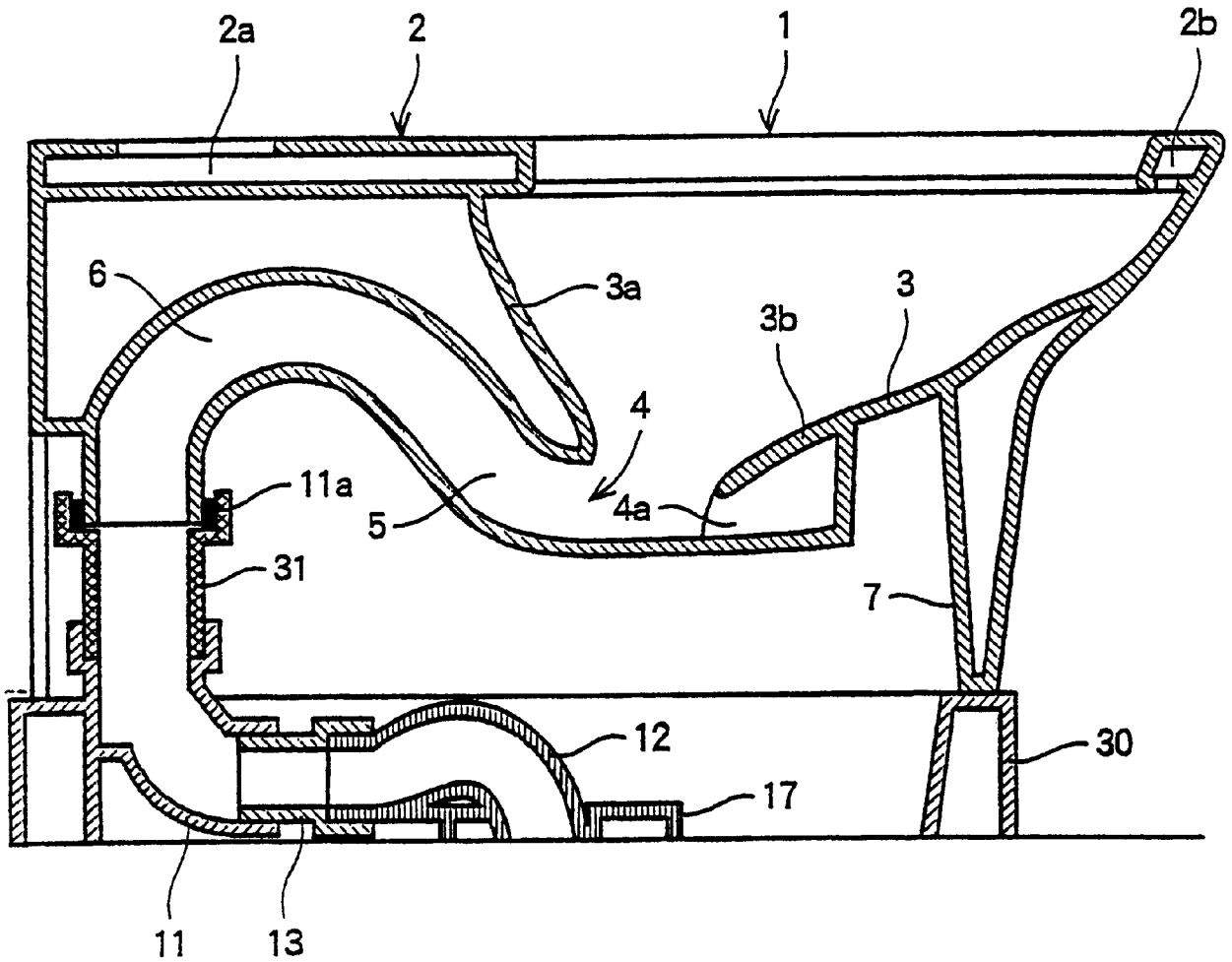
FIG. 24 shows a vertical cross-sectional view of an embodiment in which a portion of the trap device is formed as a unit together with a sub-support for installing the main body of the toilet bowl.

FIG. 24 is a vertical cross-sectional view showing an example in which a portion of the trap device is formed as a unit together with a sub-support, which can be formed in various heights, for installation of the main body of the toilet bowl. In this embodiment, the main body 1 of the toilet bowl is set on the sub-support 30 so as to adjust the height of the toilet 1, thereby making the use thereof easy for handicapped persons.

And, the upper stream connection pipe 11 forming the trap device 10 is formed as a unit on the sub-support 30 with the connection pipe 13, the lower stream connection pipe 12 and the plate 17, these elements being separated from the sub-support 30 for adjusting the "rough-in" and the upper stream connection pipe 11. Further, for adjustment between the upper stream connection pipe 11 and the falling pipe 6, which are interconnected by a connection pipe 31.

However instead of forming the connecting pipe 31 separately, the upper connection pipe 11 can be formed to extend further upward to the front.

Figure 25:
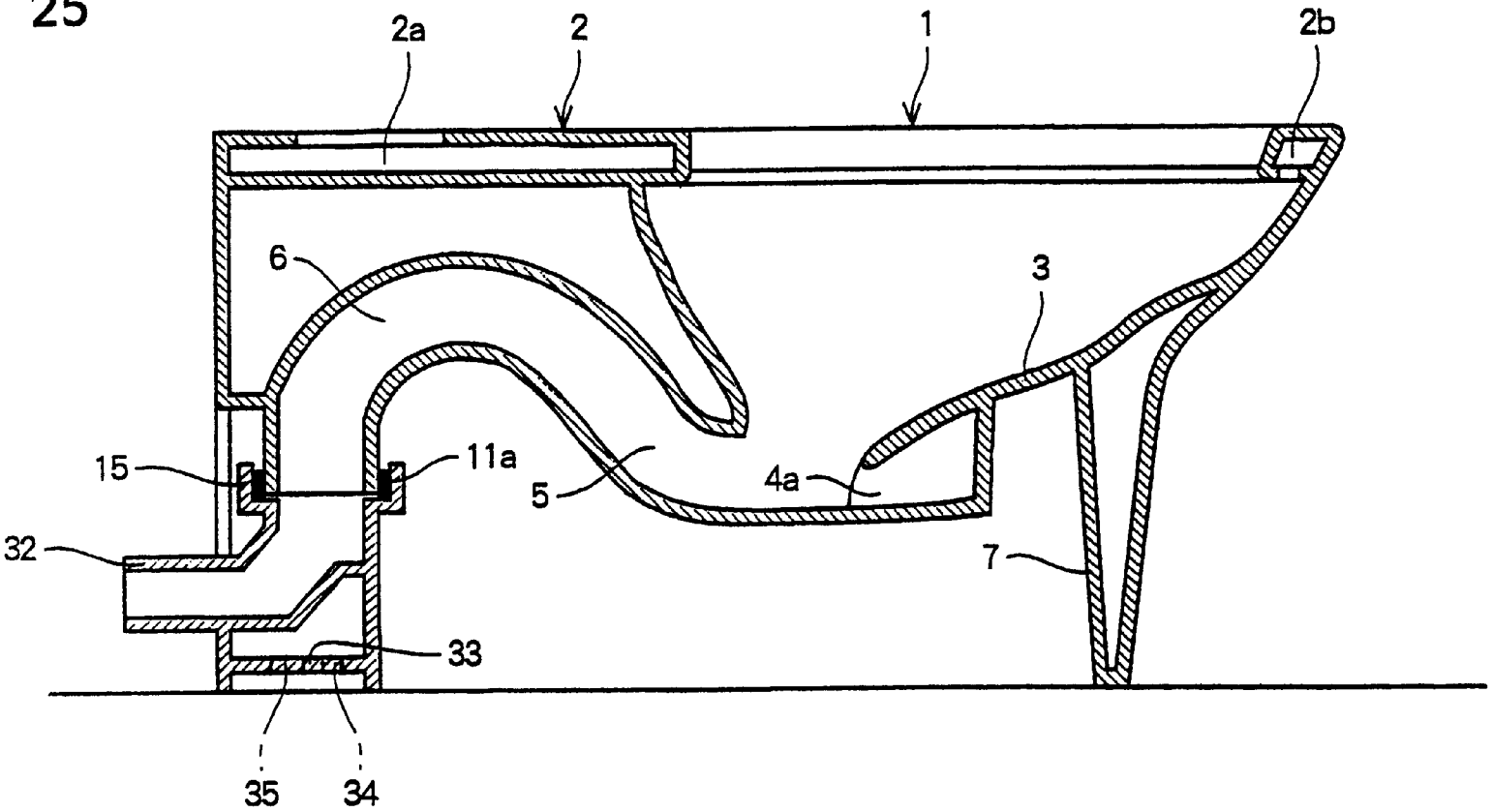
FIG. 25 shows a vertical cross-sectional view of an embodiment which is especially adapted to a wall type drain among the flush toilet bowls in accordance with the present invention.

Further, FIG. 25 shows an example which is applied to a water flush toilet bowl of a side wall drain type among the water flush toilet bowls in accordance with the present invention. In this embodiment, a pipe 32 of a shape similar to the above mentioned upper stream connection pipe 11 is attached so as to extend to the rear side, so as to obtain a construction such that it is connected to a drain opening formed in the wall surface. Here, with the pipe 32 there is provided a plate 33 as a unit, and in the plate 33 there are formed holes 34 for fixing the plate 33 with respect to the floor and a hole 35 for fixing the main body of the toilet bowl with respect to the plate 33. The hole 35 is shaped like a letter "T", thereby making it possible to finely adjust the installation position of the main body 1 of the toilet bowl.

Figure 26:
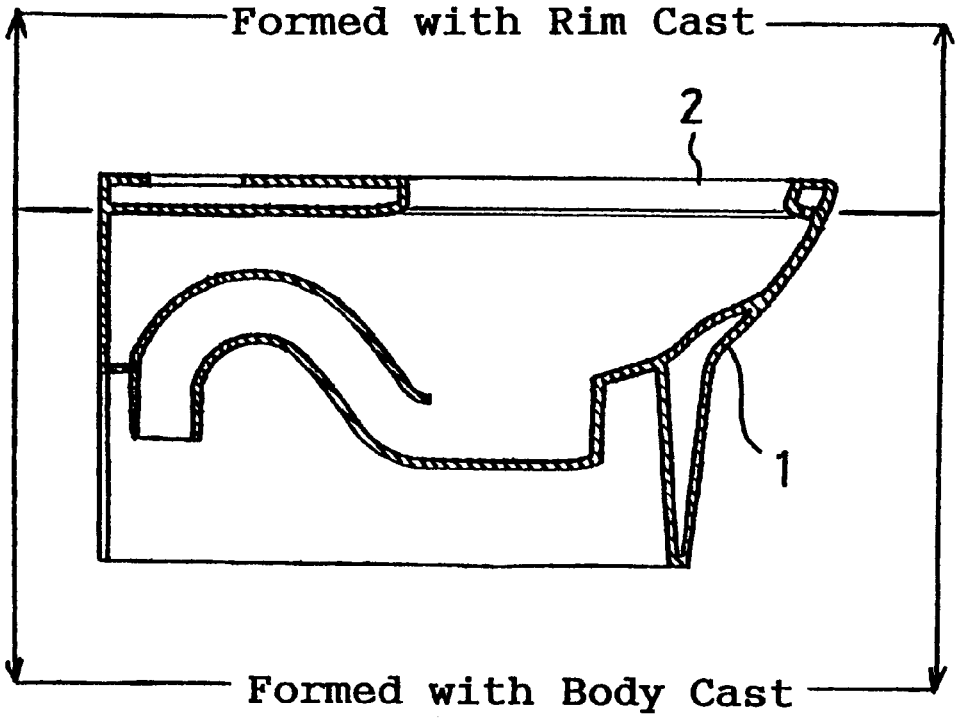
FIG. 26 shows a portion formed by a rim mold and a body mold of a cast molding apparatus, in accordance with the present invention.

Next, an explanation will be given of a cast molding apparatus for slip casting the main body 1 of the toilet bowl. As shown in FIG. 26, a rim portion 2 of the main body 1 of the toilet bowl is formed as a separate body by a rim mold and is attached afterwards. And, the main body 1 of the toilet bowl excepting the rim portion 2 is formed by using a body mold with the slip casting. With the main body 1 of the toilet bowl shown in FIG. 26, the rear plate of the bowl and the upper plate of the jet eject opening are adhered and attached in a working process afterward.

Figure 27:
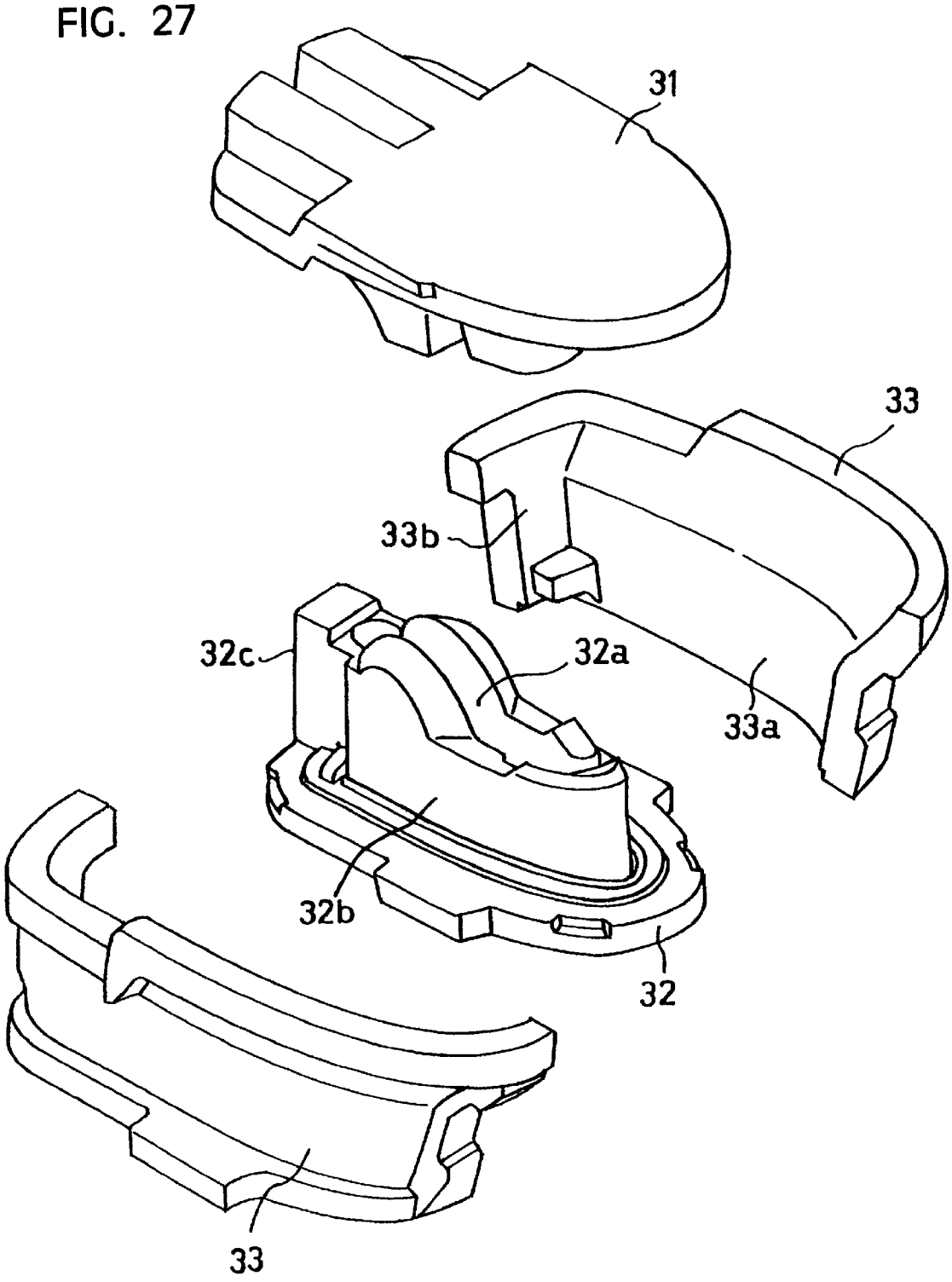
FIG. 27 shows respective molds forming the body mold.
Figure 28:
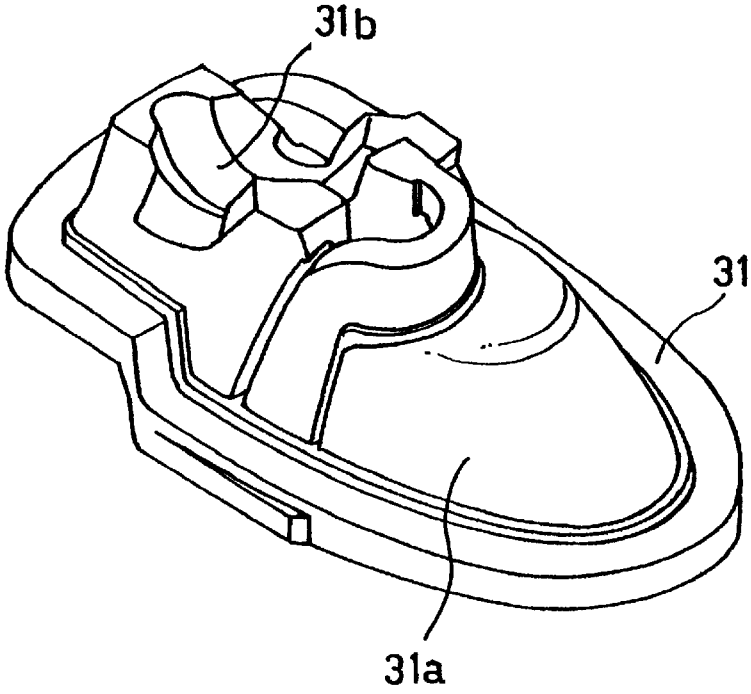
FIG. 28 shows a lower face of a top mold.

The body mold is constructed with, as shown in FIG. 27, a top mold 31, a bottom mold 32 and right and left side molds 33, and the top mold 31 has, as shown in FIG. 28, a face 31*a* for forming the bowl portion 3, and faces 31*b* for forming the upper side portions of the rising pipe 5 and the falling pipe 6.

The bottom mold 32 has faces 32*a* mfor forming lower portions of the rising pipe 5 and the falling pipe 6, a face 32*b* for forming the interior surface of the skirt portion 7, and a face 32*c* for forming the interior surface of the fold back portion 8.

Further, the right and left side molds 33 have a face 33*a* for forming the outer surface of the skirt portion 7 and a face 33*b* for forming the outer surface of the fold back portion 8.

Figure 29:
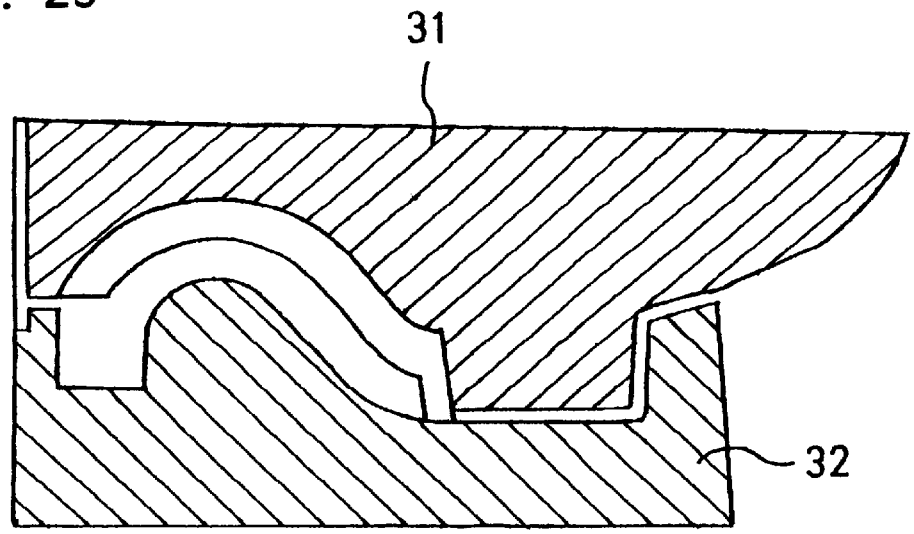
FIG. 29 shows a vertical cross-sectional view of the top mold and the bottom mold when they are fitted.

In the above, as shown in FIG. 29, by combining the top mold 31 and the bottom mold 32 and by further combining the right and left side molds, as well as by flowing (pumping) a mudlike fluid material for slip casting in the cavity defined between the molds, the bowl portion 3, the rising pipe 5 which is continuous with the drain opening 4 of the bowl portion, the falling pipe 6 which is continuous with the rising pipe, the skirt portion 7 covering the side face to the front face and the fold back portion 8 are all formed as a unit. The main body of the toilet bowl which is opened in the lower portion and the rear portion is thereby formed. Furthermore, the main body of the toilet bowl is formed by adhering and/or attaching the rear plate 3*a* of the bowl which forms a portion of the bowl portion at the side of the drain opening 4 of the toilet bowl, and the upper plate 3*b* of the jet eject opening.

Figure 30:
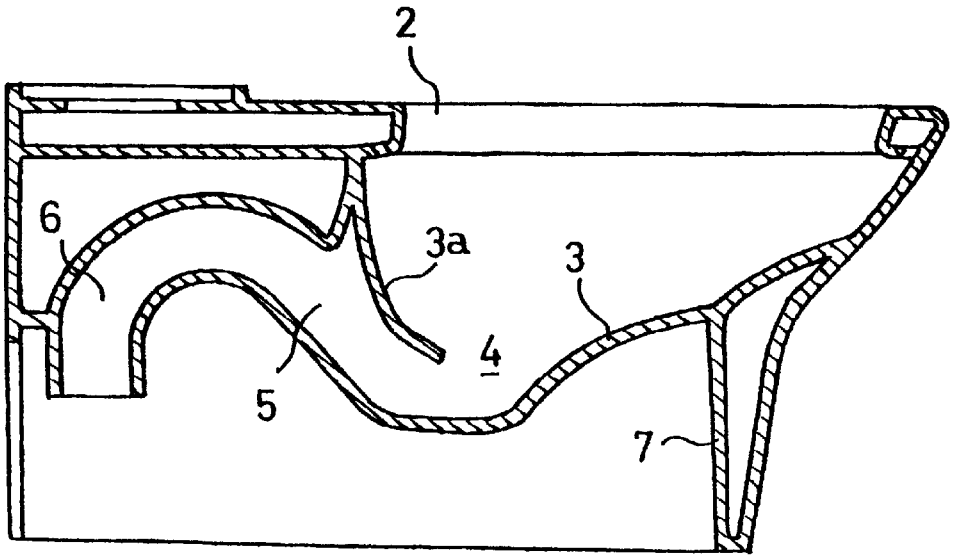
FIG. 30 shows a vertical cross-section of the main body of the toilet bowl which is formed by the cast molding apparatus in accordance with the present invention.

In this way, with the top mold 31 and the bottom mold 32 mentioned above, the rear plate 3*a* of the bowl and the upper plate 3*b* of the jet eject opening must be adhered and attached separately in the aforementioned work process afterwards. However, with the construction shown in FIG. 30 wherein the upper plate 3*b* of the jet eject opening is omitted and the rear plate 3*a* of the bowl is formed in common with part of the rising pipe 5, the adhesion and/or attachment steps in the process afterwards are not needed.

Figure 31:
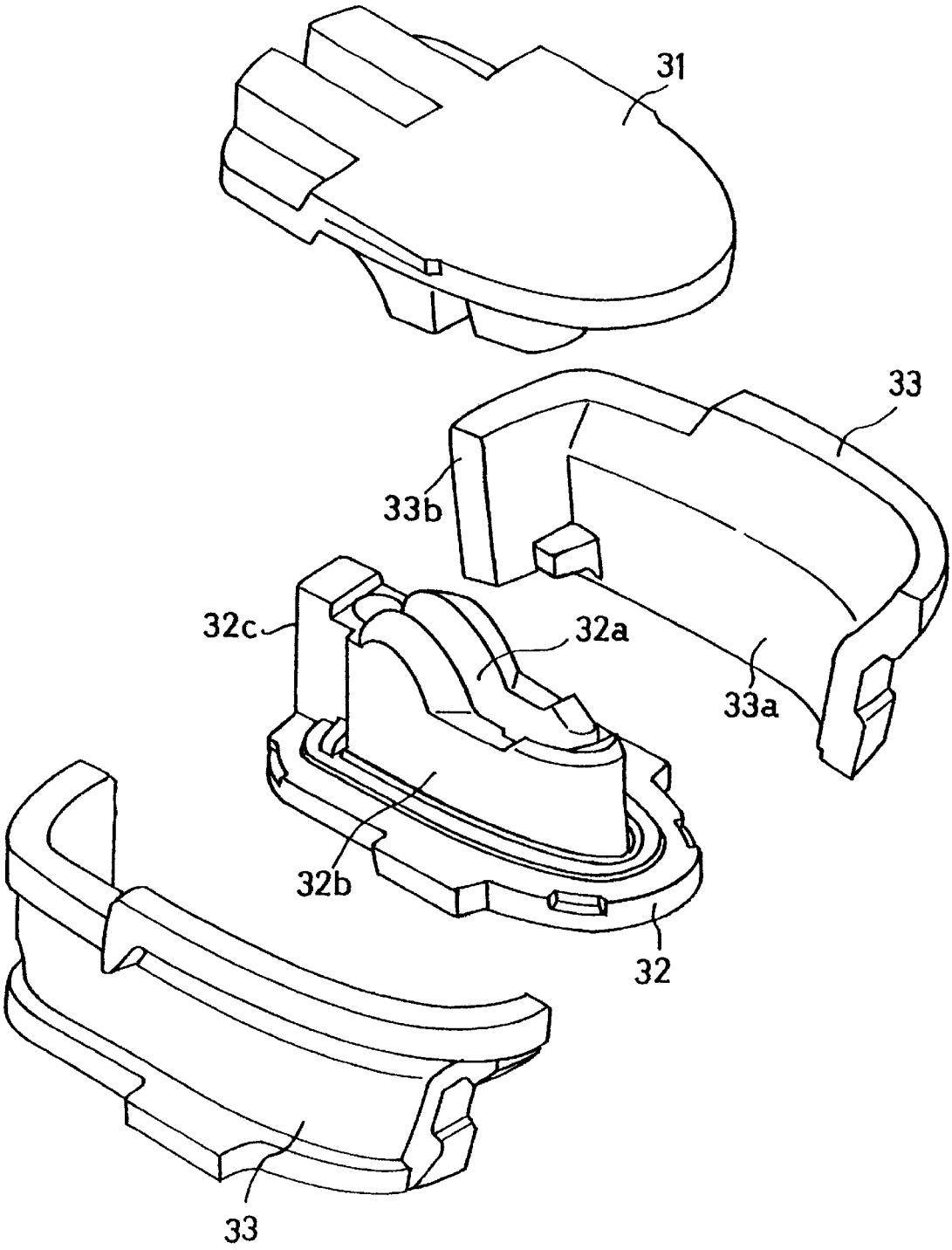
FIG. 31 shows perspective views of the respective molds forming another cast molding apparatus, in accordance with the present invention.
Figure 32:
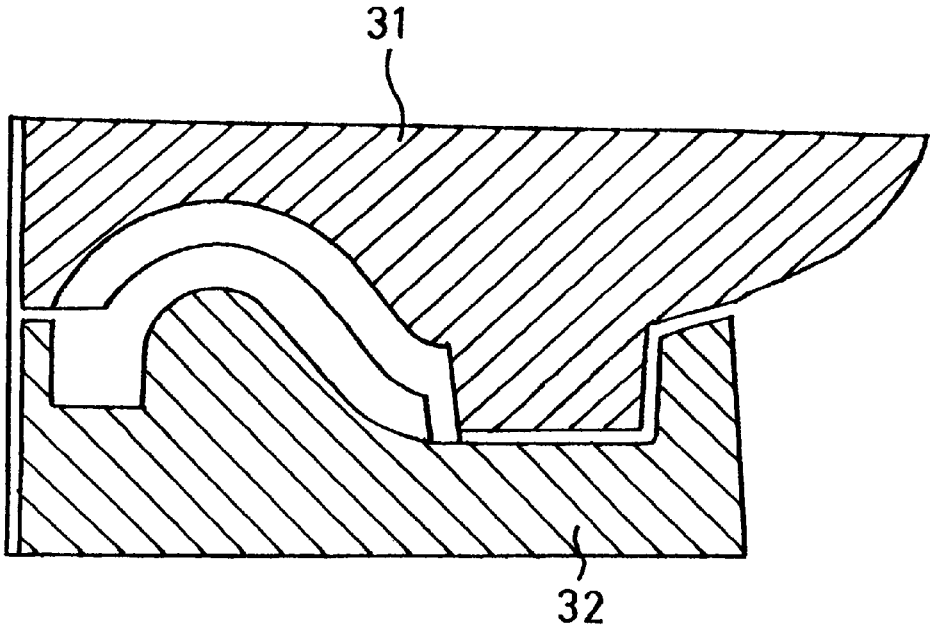
FIG. 32 shows a vertical cross-sectional view of the top mold and a bottom mold of the cast molding apparatus shown in FIG. 31 when they are fitted.
Figure 33:
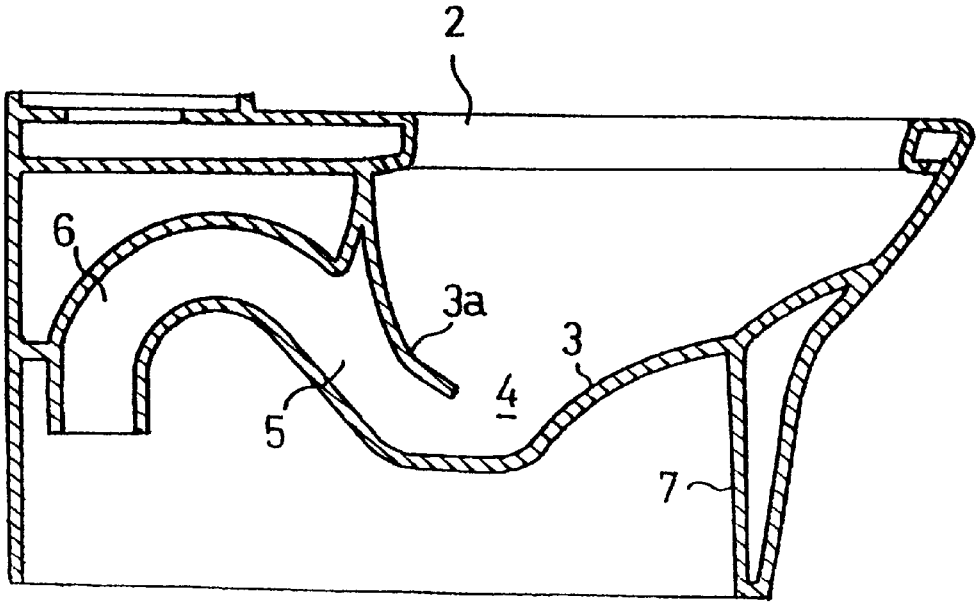
FIG. 33 shows a vertical cross-sectional view of the main body of the toilet bowl formed by the cast molding apparatus shown in FIG. 31.
Figure 34:
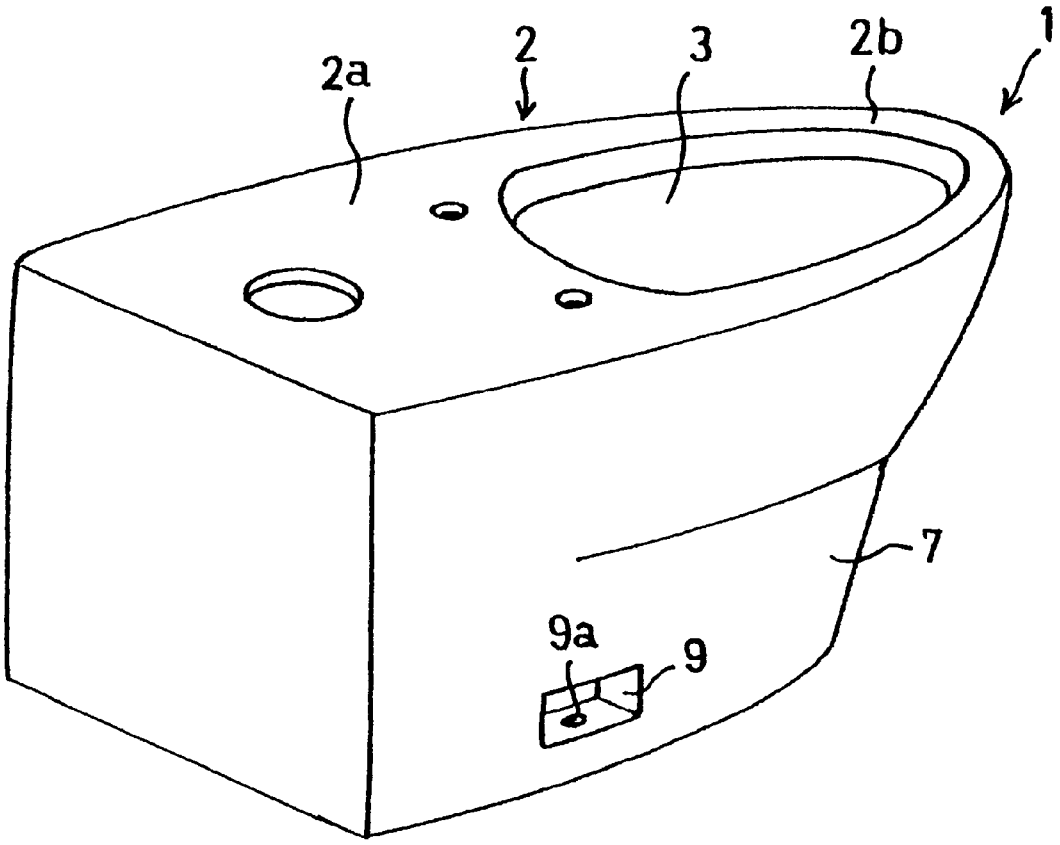
FIG. 34 shows a vertical cross-sectional view of another main body of the toilet bowl formed by the cast molding apparatus shown in FIG. 31.
Figure 35:
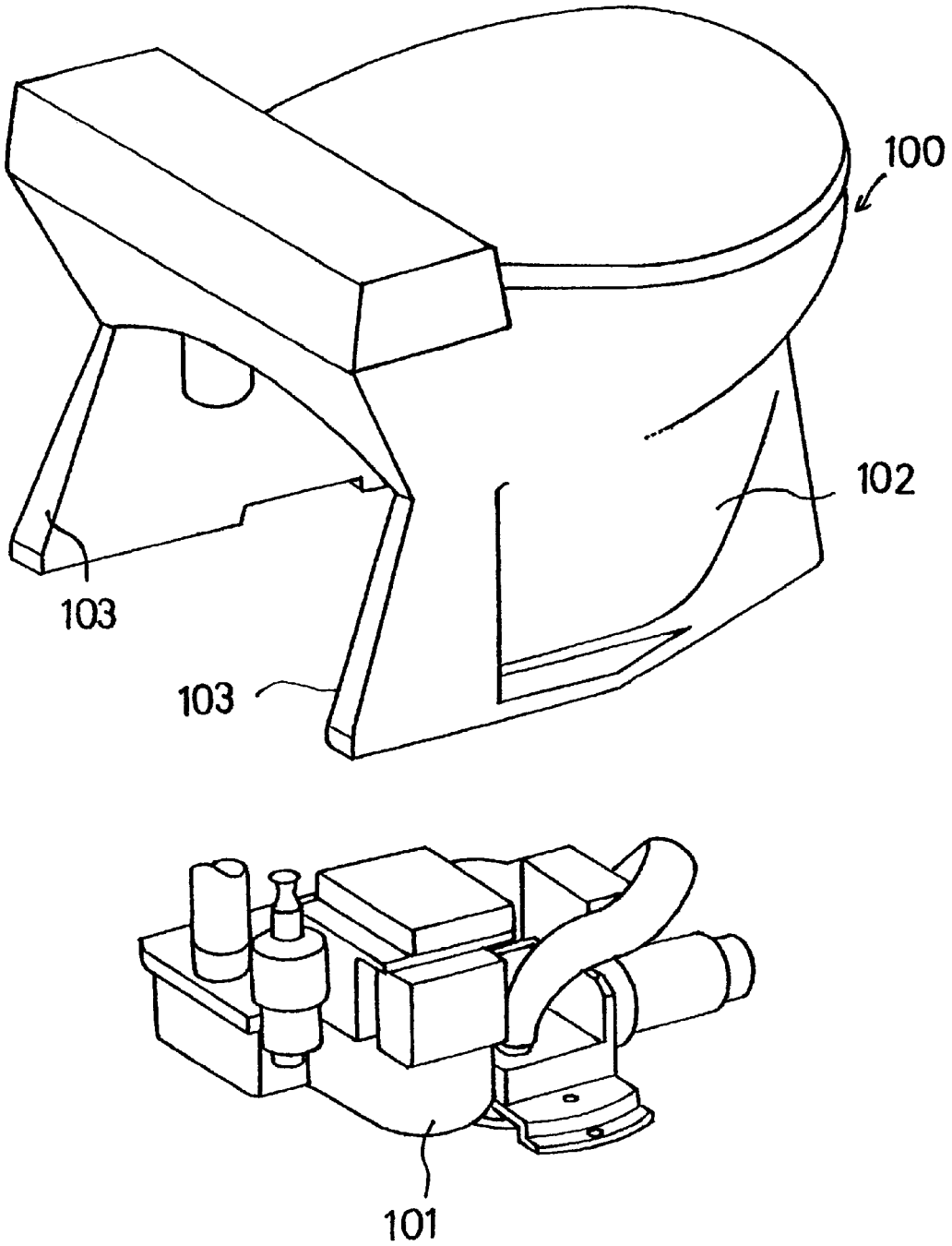
FIG. 35 PRIOR ART
FIG. 35 is a perspective view of a conventional water flush toilet bowl.

FIG. 31 shows perspective views of respective cast molds forming another body cast of the cast molding apparatus according to the present invention, and FIG. 32 shows the vertical cross-section view of the cast molding apparatus shown in FIG. 31 under the condition that the top mold and the bottom mold are fitted together. As shown in the embodiment, by abutting the faces 33*b* for forming the outer surface of the fold back portion 8 of the right and left side molds 33, it is possible to form the main body of the toilet bowl with which the rear side thereof is closed as shown in FIGS. 33 and 34.

As is explained in the above, in accordance with the present invention, the bowl portion of the main body, at least one part of the trap portion, and said trap cover portion covering said trap portion are formed as a unit integrally. The design provides for advantageous possibilities for ornamental design to be increased without the trap portion exposure on the side surface of the toilet bowl, and further it is easy to clean up because it does not easily become dirty. As said trap portion is formed by the rising pipe formed to be continuous with the drain opening of said bowl portion formed as a unit integrally, the falling pipe formed to be continuous with said rising pipe, the upper stream connection pipe formed to be continuous with the drain opening of the main body separated from the main body, and the lower stream connection pipe formed to be continuous with the drain opening formed out of the main body, it is easy to adjust "rough-in", and the advantageous possibilities for ornamental design can also be increased without exposure of the trap portion on the side surface of the toilet bowl.

As said trap cover portion is formed on the skirt portion or lap surface except for the lower portion and the rear portion, it is easy to integrate the trap portion with the main body the opening the lower portion and the rear portion.

As mentioned above, when the lower portion and the rear portion are opened, it is possible to make up for the deficiency of the strength caused by the opening of the lower portion and the rear portion.

Because said reinforcement portion formed as a folded-back portion on the rear portion, this being with the unit integrally, the advantageous possibilities for the strength and ornamental design can be increased.

When said trap cover portion is formed on a lap surface except for a lower portion, and the rear portion of the main body is closed, the advantageous possibilities and the strength can be increased as of closing the rear portion of the main body.

Further, by forming the trap device with the upper stream connection pipe which is connected to the drain opening of the main body of the toilet bowl, the lower stream connection pipe which is connected to the drain opening formed on the floor surface, and the connection pipe which interconnects between the upper and lower stream connection pipes, in addition thereto, by forming the water stay portion forming the trap seal bridging over the upper stream connection pipe, the lower stream connection pipe and the connection pipe, it is possible to create the siphon effect quickly and the trap device is effective for water conservation.

Further, since the resistance is small in the pipes at the water stay portion after creating the siphon effect, a high sucking force can be maintained which is very effective for obtaining an advantageous drain effect.

Further, by forming the water stay portion forming the trap seal only in the upper stream connection pipe, the possibility of water leakage can be eliminated in the connection portions including the upper stream connection pipe, the lower stream connection pipe and the connection pipe.

And, by providing the choking portion for adjusting the opening area of the drain opening of the lower stream connection pipe of the trap device, an appropriate drain capability can be obtained for each toilet bowl depending on the amount of flushing water and waste matter flowing in from the drain opening of the bowl portion.

Further, in the case that the sub-support is provided between the main body of the toilet bowl and the floor for height adjustment, although it is difficult to cater for different "rough-in" sizes with the construction of the conventional toilet bowl, thereby causing increased costs, as is taught by the present invention, by forming the trap device with a connecting pipe or pipes, the number of which can be increased or decreased to vary the vertical height and longitudinal length thereof, it is possible to effectively and easily cater for variations in the "rough-in" size. And by positioning the trap device inside of the sub-support, the advantageous possibilities for ornamental design can also be increased.

Further, by using the cast molding apparatus in accordance with the present invention, it is possible to form the main body of the toilet bowl, which has a trap cover portion therearound and is continuously opened in the lower face and the rear face thereof, and which is further provided with the fold back portion formed as a unit together with the main body of the toilet bowl in the rear portion thereof.

Further, without using the rear mold, it is possible to form the main body of the toilet bowl having the trap cover portion therearound and being closed in the rear portion thereof.

Although there have been described what are considered at present to be the preferred embodiments of the invention, it will be understood by persons skilled in the art that variations and modifications may be made thereto without departing from the spirit or essence of the invention. The scope of the invention is indicated by the appended claims, rather than by the foregoing description.

What is claimed is:

1. A water flush toilet bowl, wherein a bowl portion of a main body, a portion of a trap device, and a trap cover portion covering said trap portion are formed as a unit integrally, said trap cover portion is formed as a skirt portion of said main body except for a lower portion and a rear portion thereof, and a reinforcing fold back portion is formed from said main body as a unit in the rear portion thereof.

2. A water flush toilet bowl as defined in claim 1, wherein the trap portion includes a rising pipe formed to be continuous with a drain opening of said bowl portion formed as a unit integrally, and a falling pipe formed to be continuous with said rising pipe, said trap device includes an upper stream connection pipe and a lower stream connection pipe, said upper stream connection pipe is connected with a drain opening of said falling pipe, said lower stream connection pipe is connected with a drain opening formed in a floor, and a water stay portion for forming a trap seal is defined extending over the upper stream connection pipe and said lower stream connection pipe.

3. A water flush toilet bowl as defined in claim 2, wherein convex and concave parts engaging each other are provided on said upper stream connection pipe and said lower stream connection pipe for aligning connection of said pipes.

4. A water flush toilet bowl as defined in claim 3, wherein said main body of the toilet bowl is fixed onto the floor through one of the upper stream connection pipe and the lower stream connection pipe, and means for finely adjusting a position of the main body of the toilet bowl is provided on one of the main body of the toilet bowl, the upper stream connection pipe and the lower stream connection pipe.

5. A water flush toilet bowl as defined in claim 2, wherein said main body of the toilet bowl is fixed onto the floor through one of the upper stream connection pipe and the lower stream connection pipe, and means for finely adjusting a position of the main body of the toilet bowl is provided on one of the main body of the toilet bowl, the upper stream connection pipe and the lower stream connection pipe.

6. A water flush toilet bowl as defined in claim 5, wherein said means for finely adjusting comprises a plate, a flange portion, a joint bolt for fastening said plate, said flange portion and said main body of the toilet bowl, and a plurality of attachment holes formed in said main body of the toilet bowl.

7. A water flush toilet bowl as defined in claim 5, wherein said means for finely adjusting comprises a plate, a flange portion, a joint bolt for fastening said plate, said flange portion and said main body of the toilet bowl, and a hole of oval shape formed in said main body of the toilet bowl.

8. A water flush toilet bowl as defined in claim 5, wherein at least a portion of said trap device is formed as a unit together with an adjusting element for adjusting a setting height of said main body of the toilet bowl.

9. A water flush toilet bowl as defined in claim 2, wherein at least a portion of said trap device is formed as a unit together with an adjusting element for adjusting a setting height of said main body of the toilet bowl.

10. A water flush toilet bowl as defined in claim 2, wherein a choking portion for adjusting an opening area is provided at an opening portion of a drain side of the lower stream connection pipe of said trap device.

11. A water flush toilet bowl as defined in claim 1, wherein the trap portion includes a rising pipe formed to be continuous with a drain opening of said bowl portion formed as a unit integrally, and a falling pipe formed to be continuous with said rising pipe, said trap device includes an upper stream connection pipe and a lower stream connection pipe, said upper stream connection pipe is connected with a drain opening of said falling pipe, said lower stream connection pipe is connected with a drain opening formed in a floor, and a water stay portion for forming a trap seal is defined in the upper stream connection pipe.

12. A water flush toilet bowl as defined in claim 11, wherein convex and concave parts engaging each other are provided on said upper stream connection pipe and said lower stream connection pipe for aligning connection of said pipes.

13. A water flush toilet bowl as defined in claim 1, wherein the trap portion includes a rising pipe formed to be continuous with a drain opening of said bowl portion formed as a unit integrally, and a falling pipe formed to be continuous with said rising pipe, said trap device includes an upper stream connection pipe, a lower stream connection pipe and an intermediate connection pipe, said upper stream connection pipe is connected with a drain opening of said falling pipe, said lower stream connection pipe is connected with a drain opening formed in a floor, said intermediate connection pipe connects said upper stream connection pipe with said lower stream connection pipe, and a water stay portion for forming a trap seal is defined extending over the upper stream connection pipe, said lower stream connection pipe and said intermediate connection pipe.

14. A water flush toilet bowl as defined in claim 13, wherein convex and concave parts engaging each other are provided on said upper stream connection pipe, said lower stream connection pipe and said intermediate connection pipe for aligning connection of said pipes.

15. A water flush toilet bowl as defined in claim 14, wherein an external diameter of said connection pipe is nearly equal to an internal diameter of the upper stream connection pipe and an internal diameter of the lower stream connection pipe whereby the connection pipe can slide in engagement with respect to the upper stream connection pipe and the lower stream connection pipe with no escape of liquid.

16. A water flush toilet bowl as defined in claim 13, wherein an external diameter of said connection pipe is nearly equal to an internal diameter of the upper stream connection pipe and an internal diameter of the lower stream connection pipe whereby the connection pipe can slide in engagement with respect to the upper stream connection pipe and the lower stream connection pipe with no escape of liquid.

17. A water flush toilet bowl as defined in claim 16, wherein said connection pipe, the upper stream connection pipe and the lower stream connection pipe are formed for fitting into each other.

18. A water flush toilet bowl as defined in claim 1, wherein the trap portion includes a rising pipe formed to be continuous with a drain opening of said bowl portion formed as a unit integrally, and a falling pipe formed to be continuous with said rising pipe, said trap device includes an upper stream connection pipe, a lower stream connection pipe and an intermediate connection pipe, said upper stream connection pipe is connected with a drain opening of said falling pipe, said lower stream connection pipe is connected with a drain opening formed in a floor, said intermediate connection pipe connects said upper stream connection pipe with said lower stream connection pipe, and a water stay portion for forming a trap seal is defined in the upper stream connection pipe.

19. A water flush toilet bowl as defined in claim 18, wherein convex and concave parts engaging each other are provided on said upper stream connection pipe, said lower stream connection pipe and said intermediate connection pipe for aligning connection of said pipes.

20. A water flush toilet bowl as defined in claim 18, wherein an external diameter of said connection pipe is nearly equal to an internal diameter of the upper stream connection pipe and an internal diameter of the lower stream connection pipe whereby the connection pipe can slide in engagement with respect to the upper stream connection pipe and the lower stream connection pipe with no escape of liquid.

* * * * *

UNITED STATES PATENT AND TRADEMARK OFFICE

CERTIFICATE OF CORRECTION

PATENT NO. : 6,292,956 B1
DATED : September 25, 2001
INVENTOR(S) : Toshiaki Kayahara It is certified that error appears in the above-identified patent and that said Letters Patent is hereby corrected as shown below:

Column 1,
Line 38, change “In” to -- in --.
Line 54, before “build” insert -- to --.

Column 4,
Line 1, after “18” insert -- is --.
Line 10, before “drawing” insert -- a --.
Line 61, after “3” insert -- is --.

Column 5,
Line 39, change “16*a* with” to -- 16*a* which --.

Column 6,
Line 11, change “and, FIG. 9” to -- in FIG. 7, and FIG. 9 --.

Column 7,
Line 16, after “12” insert a comma.

Column 8,
Line 11, before “strong” insert -- are --.
Line 19, change “fastners” to -- fasteners --.
Line 22, delete “or other fastEners”.
Line 23, change “lid portion” to -- lid portions --; change “cut portion” to -- cut portions --.
Line 27, change “portionS” to -- portions --.

Column 9,
Line 39, change “mfor” to -- for --.

UNITED STATES PATENT AND TRADEMARK OFFICE

CERTIFICATE OF CORRECTION

PATENT NO. : 6,292,956 B1
DATED : September 25, 2001
INVENTOR(S) : Toshiaki Kayahara It is certified that error appears in the above-identified patent and that said Letters Patent is hereby corrected as shown below:

Column 10,
Line 39, delete "the opening the lower portion and the rear portion".

Signed and Sealed this

Thirteenth Day of August, 2002

*Attest:*

*Attesting Officer*

JAMES E. ROGAN
*Director of the United States Patent and Trademark Office*